US011273615B2

(12) United States Patent
Wetsch

(10) Patent No.: US 11,273,615 B2
(45) Date of Patent: Mar. 15, 2022

(54) STOCK MATERIAL WITH DAISY CHAIN CONNECTORS

(71) Applicant: PREGIS INNOVATIVE PACKAGING LLC, Deerfield, IL (US)

(72) Inventor: Thomas D. Wetsch, St. Charles, IL (US)

(73) Assignee: Pregis Innovative Packaging LLC, Deerfield, IL (US)

( * ) Notice: Subject to any disclaimer, the term of this patent is extended or adjusted under 35 U.S.C. 154(b) by 180 days.

(21) Appl. No.: 16/510,521

(22) Filed: Jul. 12, 2019

(65) Prior Publication Data

US 2020/0016859 A1 Jan. 16, 2020

Related U.S. Application Data

(60) Provisional application No. 62/783,779, filed on Dec. 21, 2018, provisional application No. 62/697,148, filed on Jul. 12, 2018.

(51) Int. Cl.
*B31D 5/00* (2017.01)

(52) U.S. Cl.
CPC ..... *B31D 5/0043* (2013.01); *B31D 2205/007* (2013.01); *B31D 2205/0035* (2013.01); *B31D 2205/0047* (2013.01)

(58) Field of Classification Search
CPC ..... B31D 5/0043; B31D 2205/007; B31D 2205/0035; B31D 2205/0047; B31D 2205/0017; B31D 2205/0023; B31D 2205/0005; B65D 77/245
See application file for complete search history.

(56) References Cited

U.S. PATENT DOCUMENTS 5,135,789 A * 8/1992 Schmidt ..... B31D 1/021 281/5
5,323,981 A * 6/1994 Dionne ..... B65H 19/102 156/502
6,756,096 B2 * 6/2004 Harding ..... B31D 5/0047 428/192
7,771,338 B2 8/2010 Wetsch
(Continued)

OTHER PUBLICATIONS

International Search Report and Written Opinion for International Application No. PCT/US2019/041666, filed Jul. 12, 2019, dated Nov. 11, 2019.

*Primary Examiner* — Thomas M Wittenschlaeger
(74) *Attorney, Agent, or Firm* — Fox Rothschild LLP

(57) ABSTRACT

A stock material unit for a dunnage conversion machine is provided herein. The stock material includes a first strip of sheet material at least partially defining a three-dimensional configuration. The strip of sheet material includes a first end and a second end opposite the first end. The stock material includes a splice member mounted with respect to the sheet material in a first position. The splice member includes a connector that has a bonding member configured to stick to the first end. The connector is releasable from the first position and repositionable to a second position in which it is affixed to the first end by a connecting portion. In the second position, the connecting portion has an exposed area for affixing to a second end of a second continuous sheet of the material to daisy chain the first and second strips of sheet material.

31 Claims, 20 Drawing Sheets

(56) References Cited

U.S. PATENT DOCUMENTS

| | | | | |
|---|---|---|---|---|
| 10,071,535 | B2 * | 9/2018 | Wetsch | B31D 5/0043 |
| 10,625,484 | B2 * | 4/2020 | Chan | B65H 20/16 |
| 10,875,733 | B2 * | 12/2020 | Dominak | B31D 5/0043 |
| 2003/0216236 | A1 * | 11/2003 | Harding | B31D 5/0047 493/350 |
| 2004/0142806 | A1 * | 7/2004 | Coppus | B31D 5/0047 493/350 |
| 2008/0153685 | A1 * | 6/2008 | Cheich | B65D 81/05 493/381 |
| 2012/0035038 | A1 * | 2/2012 | Lembach | B31D 5/0047 493/381 |
| 2012/0165172 | A1 * | 6/2012 | Wetsch | B65H 35/008 493/352 |
| 2014/0038805 | A1 * | 2/2014 | Wetsch | B31D 5/0043 493/464 |
| 2014/0274647 | A1 * | 9/2014 | Wetsch | B31D 5/0043 493/464 |
| 2015/0014205 | A1 * | 1/2015 | Yap | B65D 85/07 206/494 |
| 2015/0056339 | A1 * | 2/2015 | Vaes | B65D 77/32 426/115 |
| 2016/0151991 | A1 | 6/2016 | Wetsch | |
| 2016/0270575 | A1 * | 9/2016 | Panone | A47G 21/145 |
| 2017/0021585 | A1 * | 1/2017 | Wetsch | B65H 20/26 |
| 2017/0095991 | A1 * | 4/2017 | Wetsch | B31D 5/0039 |

* cited by examiner

STOCK MATERIAL WITH DAISY CHAIN CONNECTORS

CROSS-REFERENCE TO RELATED APPLICATIONS

This application claims the benefit of priority pursuant to 35 U.S.C. § 119(e) of U.S. provisional patent application No. 62/783,779, filed 21 Dec. 2018, entitled "STOCK MATERIAL DAISY CHAIN CONNECTORS"; and of U.S. provisional patent application no. 62/697,148, filed 12 Jul. 2018, entitled, "STOCK MATERIAL DAISY CHAIN CONNECTORS," the contents of which are hereby incorporated by reference herein in their entireties.

TECHNICAL FIELD

This disclosure is in the field of packaging systems and materials. More specifically, this disclosure relates to stock material units for forming protective packaging.

BACKGROUND

In the context of paper-based protective packaging, paper sheet is crumpled to produce dunnage. Most commonly, this type of dunnage is created by running a generally continuous strip of paper into a dunnage conversion machine that converts a compact supply of stock material, such as a roll of paper or a fanfold stack of paper, into a lower density dunnage material. The supply of stock material, such as in the case of fanfold paper, is pulled into the conversion machine from a stack that is either continuously formed or formed with discrete section connected together. The continuous strip of crumpled sheet material may be cut into desired lengths to effectively fill void space within a container holding a product. The dunnage material may be produced on an as-needed basis for a packer.

Dunnage supply material may be chainable. For example, the dunnage supply arrangement comprises a first supply unit of an elongated web of material in a high-density arrangement, where the material may be converted into a low-density dunnage, and the connecting member may include an adhesive surface for adhering to a longitudinal second end of a second supply unit of material with sufficient adhesion for pulling the material of the second supply unit into the dunnage mechanism (e.g., daisy chaining the two supply units together).

SUMMARY

A stock material unit for a dunnage conversion machine is provided herein. The stock material unit includes a supply unit including a first strip of sheet material arranged in a high-density configuration and including a first end and a second end opposite the first end. A splicing member is releasably stuck to the supply unit. The splicing member includes a connector that includes a bonding member releasably stuck to the supply unit in a first position. The splicing member is releasable from the first position on the supply unit and repositionable to a second position on the supply unit by the bonding member. In the second position the bonding member is positioned for sticking to a second end of a second strip of sheet of the material to daisy chain the first and second strips of sheet material.

In accordance with various embodiments, a method for daisy chaining separate stock material units for a dunnage conversion machine is provided. The method includes providing a stock material unit for a dunnage conversion machine. The stock material unit includes a supply unit with a first strip of sheet material arranged in a high-density configuration and including a first end and a second end opposite the first end. A splicing member is releasably stuck to the supply unit, the splicing member includes a connector that includes a bonding member releasably stuck to the supply unit in a first position. The method includes removing the splicing member from the first position on the supply unit; and applying the splicing member to a second position on the supply unit in which the connector is stuck to the first end by the bonding member. In the second position, the bonding member is positioned for sticking to a second end of a second continuous sheet of the material to daisy chain the first and second strips of sheet material.

A stock material unit for a dunnage conversion machine is provided herein. The stock material unit includes a first strip of sheet material at least partially defining a three-dimensional configuration and including a first end and a second end opposite the first end; and a splicing member. The first splicing member includes a first cohesive layer affixed to a first end of the sheet material, and a second cohesive layer affixed to a second end of the sheet material. The cohesive layers are of a cohesive material that bonds strongly to corresponding cohesive layers, and has a weak bond to the strip of sheet material. The first and second cohesive layers are positioned for cohesively adhering to a cohesive at an end of a second strip of sheet material of a second stock material unit of the same construction as the stock material unit to daisy chain the first and second strips of sheet material together.

DETAILED DESCRIPTION

Figure 1C:
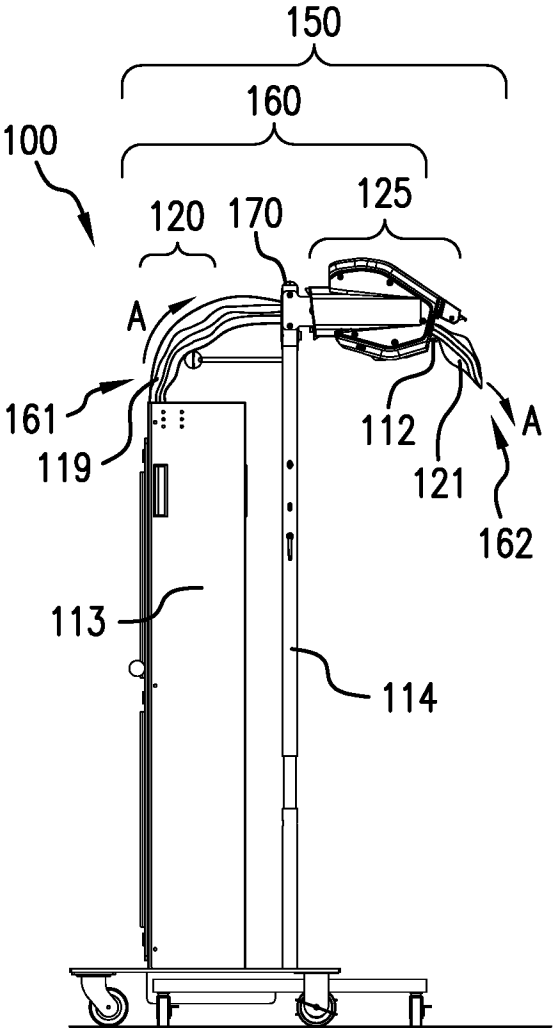
FIG. 1C is a side view of the embodiment of FIG. 1A of the conversion apparatus and supply cart holding stock material.

A system and apparatus for converting a stock material, such as that in a stock material unit, into dunnage is disclosed. The present disclosure is generally applicable to systems and apparatus where stock material, such as a stock material unit including a strip of sheet material, is processed. In some embodiments, the stock material is processed by a conversion apparatus, such as a dunnage conversion machine(s) including longitudinal crumple machine(s) that form creases longitudinally in the stock material to form dunnage or by cross crumple machine(s) that forms creases transversely across the stock material. In some embodiments, other types of machines may be used to process the stock material. For example, an apparatus such as that disclosed in U.S. Pat. No. 7,771,338 B2 or U.S. Patent Pub. Nos. US 2016/0151991 A1, US 2017/0021585 A1, or U.S. 2017/0095991 A1, and the contents thereof are fully incorporated herein. The stock material may be continuous. The stock material can have perforations that extend through all or portion of the thickness of the stock material. Perforations can extend in a transverse or longitudinal directions, or a combination thereof, across all or a portion of the stock material. The conversion apparatus is operable to drive the stock material in a first direction, which may be a dispensing direction. In some embodiments, the conversion apparatus is fed the stock material from a repository in a dispensing direction. The stock material may include a variety of types of protective packaging material including paper or fiber-based materials in sheet form, other dunnage and void fill materials, inflatable packaging pillows, etc. Some embodiments may use supplies of thermoplastic materials, such as a web of plastic material usable to form pillow packaging material.

In some embodiments, the conversion apparatus is used with a cutting mechanism operable to sever the dunnage material. The conversion apparatus may include a mechanism for cutting or assisting the cutting of the dunnage material at desired lengths. In some embodiments, a biasing member is used to bias the dunnage material against or around a cutting member to improve the ability of the system to sever the dunnage material. The biased position of the dunnage material may be used in connection with or separately from other cutting features such as reversing the direction of travel of the dunnage material through the conversion apparatus.

With reference to FIGS. 1A, 1B, 1C, and 2 an example of a dunnage conversion system 100 is disclosed. The dunnage conversion system 100 may include one or more of a supply of stock material 119 and a dunnage apparatus 150. The dunnage apparatus 150 may include one or more of a supply station 113 and a dunnage conversion machine 102. The dunnage conversion machine 102 may include one or more of a converting station 160, a drive mechanism 125, and a support portion 114. Generally the dunnage conversion system 100 is operable for processing the stock material 119 into dunnage material 121. In accordance with various embodiments, the converting station 160 includes an intake or inlet guide 170 that receives the stock material 119 from the supply station 113. The drive mechanism 125 is able to pull or assist in pulling the stock material 119 into and through the intake 170. In some embodiments, the stock material 119 engages a forming member 120 prior to the intake or inlet guide 170.

The stock material 119 may be delivered from a bulk material supply to the converting station 160 for converting to dunnage material 121 and then through the drive mechanism 125 and the cutting edge 112.

Figure 1B:
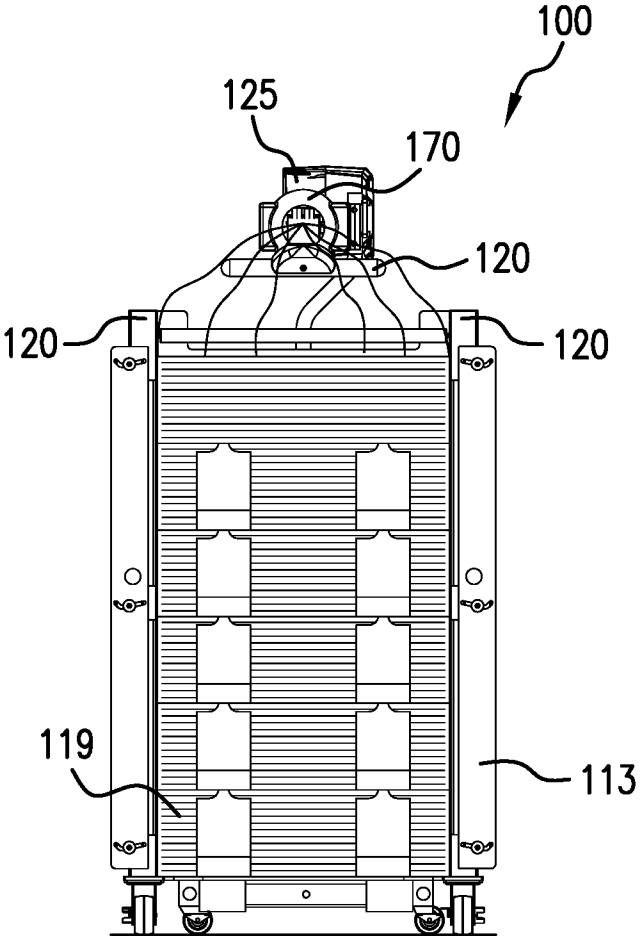
FIG. 1B is a rear view of the embodiment of FIG. 1A of the conversion apparatus and supply cart holding stock material.
Figure 1A:
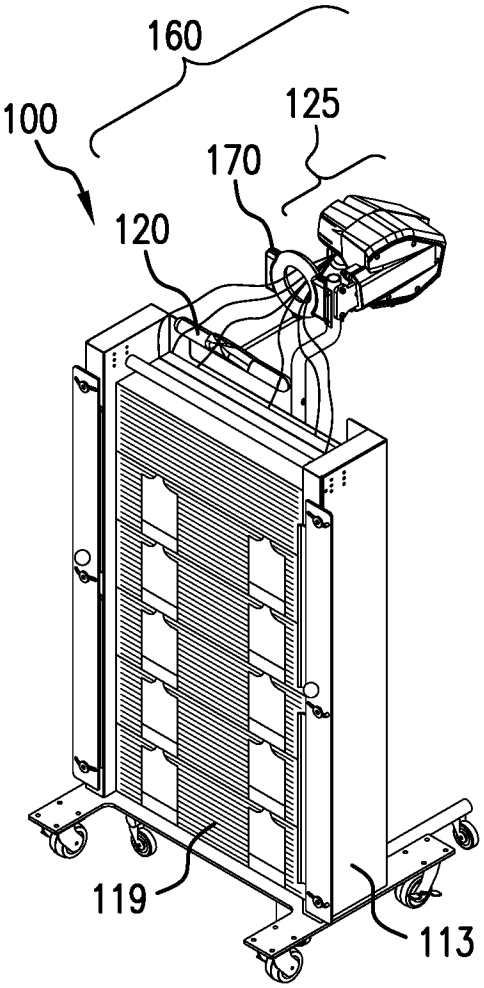
FIG. 1A is a perspective view of an embodiment of a conversion apparatus and supply cart holding stock material.

In accordance with various examples, as shown in FIGS. 1A and 1B, the stock material 119 may be allocated from a bulk material supply. The stock material 119 in this embodiment is stored as stacked bales of fan-fold material. Other embodiments can have another type or configuration of supply or stock material. The stock material 119 may be contained in the supply station 113, such as a cart, or may be positioned freely on a table or support surface. For example, the supply station 113 may be a single magazine, basket, or other container mounted to or near the dunnage conversion system 100.

The stock material 119 is fed from the supply side 161 through the intake or inlet guide 170. The stock material 119 begins being converted from dense stock material 119 to less dense dunnage material 121 by the intake or inlet guide 170 and then pulled through the drive mechanism 125 and dispensed in a dispensing direction A on the out-feed side 162 of converting station 160. The material can be further converted by the drive mechanism 125 by allowing rollers or similar internal members to crumple, fold, flatten, or perform other similar methods that further tighten the folds, creases, crumples, or other three-dimension structure created by intake 170 into a more permanent shape creating the low-density configuration of dunnage material. The stock material 119 can include continuous (e.g. continuously connected stacks, rolls, or sheets of stock material), or non-continuous (e.g. single discrete or short lengths of stock material) stock material 119 allowing for continuous, semi-continuous or non-continuous feeds into the dunnage conversion system 100. Multiple lengths can be daisy-chained together.

A motor 111 or other suitable advancement mechanism can be used to drive the dunnage conversion system 100. The motor 111 can be controlled by a user of the system, for example, by a foot pedal, a switch, a button, an automated controller, or other suitable system. The motor 111 is part of a drive portion of the dunnage conversion system 100, and the drive portion includes a transmission for transferring power from the motor 111. Alternatively, a direct drive can be used. The motor 111 is arranged in a housing and is secured to a first side of a central housing, and a transmission is contained within the central housing and operably connected to a drive shaft of the motor 111 and a drive portion, thereby transferring motor 111 power. Other suitable powering arrangements can be used.

Figure 2:
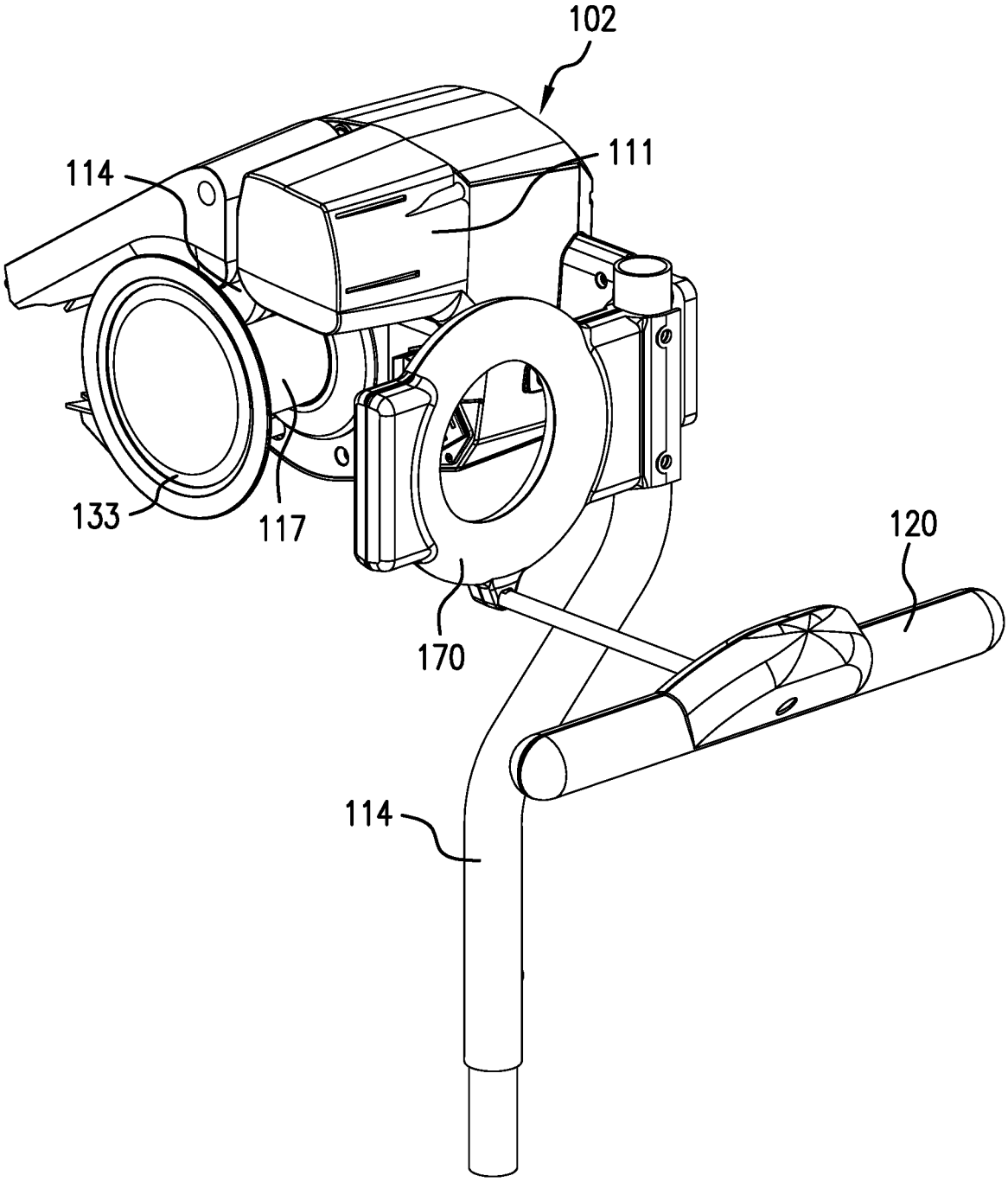
FIG. 2 is a perspective view of an embodiment of the dunnage conversion system of FIG. 1A.

The motor 111 of the embodiment shown in FIG. 2, drives a drum 117, which causes the drum 117 to rotate with the motor 111 in a dispensing direction, which causes drum 117 to dispense the dunnage material 121 by driving it in the dispensing direction, depicted as arrows "A" in FIG. 1C. The drum 117 can also be driven, such as by the motor 111 or other driving element, in a reverse direction (i.e., opposite of the dispensing direction) to withdraw the dunnage material 121 back into the conversion machine in the direction opposite of A, such as to assist in cutting the material or to cut the material against a blade, as disclosed, for example in US. Patent Pub. Nos. U.S. 2016/0151991 A1, U.S. 2017/0021585 A1, and U.S. 2017/0095991 A1. The stock material 119 is fed from the supply side 161 of the converting station 161 and over the drum 117, forming the dunnage material 121 that is driven in the dispensing direction "A" when the motor 111 is in operation. While described herein as a drum, this element of the driving mechanism may also be wheels, conveyors, belts, or any other device operable to advance stock material or dunnage material through the system.

As shown in FIG. 2, some embodiments of the dunnage conversion system 100 may include a pinch portion operable to press on the material as it passes through the drive mechanism 125 (FIGS. 1A-1C). As an example, the pinch portion includes a pinch member such as a wheel, roller, sled, belt, multiple elements, or other similar member. In one example, the pinch portion includes a pinch wheel 114. The pinch wheel can be powered and driven. The pinch wheel 114 is positioned adjacent to the drum such that, during operation, the material passes between the pinch wheel 114 and the drum 117. The pinch wheel 114 may have a variety of sizes, shapes, or configurations. In the example of FIG. 2, the pinch wheel 114 is engaged in a position biased against the drum 117 for engaging and crushing the stock material 119 passing between the pinch wheel 114 and the drum 117 to convert the stock material 119 into dunnage material 121.

In operation, the stock material 119 may be pulled into and through the intake or inlet guide 170. The drive mechanism 125 may control the incoming stock material 119 in a suitable manner to advance it through the converting station 160 to form the dunnage material 121 and advance the dunnage material 121 to the cutting edge 112. Material path A, shown in FIG. 1C, illustrates the path of the stock material 119 through the apparatus and is converted into the dunnage material 121.

As discussed above, a variety of stock material may be used. For example, the stock material 119 is typically a paper sheet material, such as kraft paper or other suitable paper, typically having a basis weight of about at least 20 lbs., typically to about at most 100 lbs. In some embodiments, the stock material 119 comprises paper stock stored in a high-density configuration having a first longitudinal end and a second longitudinal end that is later converted into a low-density configuration. In some embodiments, the stock material 119 is a ribbon of sheet material that is stored in a fan-fold structure, as shown in FIG. 1A, or in coreless rolls. The stock material 119 may be formed or stored as single-ply or multiple plies of material. Where multi-ply material is used, a layer can include multiple plies. It is also appreciated that other types of material can be used, such as pulp-based virgin and recycled papers, newsprint, cellulose and starch compositions, and poly or synthetic material, of suitable thickness, weight, and dimensions.

In some embodiments, the stock material 119 may be provided as any suitable number of discrete stock material units. In some embodiments, two or more stock material units may be connected together to provide a continuous feed of material into the dunnage conversion machine 102 that feeds through the connected units, sequentially or concurrently (i.e., in series or in parallel). Moreover, as described above, the stock material units may have any number of suitable sizes and configurations and may include any number of suitable sheet materials. Generally, the term "sheet material" refers to a material that is generally sheet-like and two-dimensional (e.g., where two dimensions of the material are substantially greater than the third dimension, such that the third dimension is negligible or de minimus in comparison to the other two dimensions). Moreover, the sheet material is generally flexible and foldable, such as the example materials described herein.

In some embodiments, the stock material units may each include a strip of sheet material with fanfold configurations. For example, a foldable or rollable material, such as paper, may be folded repeatedly to form a stack or a three-dimensional body or fan folded bale. In some embodiments, the stock material units can each include a strip of sheet material in a rolled configuration. The term "three-dimensional body," in contrast to the "two-dimensional" material, has three dimensions all of which are non-negligible. In an embodiment, a strip of sheet material may be folded at multiple fold lines that extend transversely to a longitudinal direction of the sheet or transversely to the feed direction of the sheet. In some examples, the strip of sheet material may include a sheet of paper, plastic, foil, or a hybrid material made from a combination thereof. For example, folding a continuous sheet that has a substantially uniform width along transverse fold lines (for example, fold lines oriented perpendicularly relative to the longitudinal direction) may form or define sheet sections that have approximately the same width. In an embodiment, the strip of sheet material may be folded sequentially in opposite or alternating directions to produce an accordion-shaped strip of sheet material. For example, folds may form or define sections along the strip of sheet material, which may be substantially rectangular.

In some examples, sequentially folding the strip of sheet material may produce an accordion-shaped strip of sheet material with sheet sections that have approximately the same size and/or shape as one another. In some embodiments, multiple adjacent sections that are defined by the fold lines may be generally rectangular and may have the same first dimension, for example corresponding to the width of the continuous sheet, and the same second dimension that is generally along a longitudinal direction of the continuous sheet. For example, when the adjacent sections are contacting one another, the continuous sheet may be configured as a three-dimensional body or a stack. In some embodiments, the accordion shape that is formed by the folds may be compressed, such that the continuous sheet forms a three-dimensional body or stack.

It should be appreciated that the fold lines may have any suitable orientation relative to one another as well as relative to the longitudinal and transverse directions of the continuous sheet. Moreover, the stock material unit may have transverse folds that are parallel one to another, for example compressing together the sections that are formed by the fold lines may form a three-dimensional body that is rectangular prismoid. In some embodiments, the stock material unit may also have one or more folds that are non-parallel relative to the transverse folds.

In various embodiments, one or more of units of stock material 119 may include a splice member that may be used to connect or couple multiple units of stock material to produce a continuous material feed so that a continuous stream of material may be fed into the converting station 160. In some embodiments, the splice member is used to daisy chain a first strip of sheet material to a second strip of sheet material.

Pressure sensitive adhesives may be selected that bond non-adhesive members together after applying a slight, initial, external pressure to create the bond. Examples of these include water-based, acrylic, pressure sensitive adhesives, similar to what is applied to packaging tape in that the material holds two surfaces together solely by surface contact, often upon a slight initial external pressure. Pressure sensitive adhesives can be selected that are aggressive and permanently tacky at room temperature. Examples of water based, acrylic, pressure sensitive adhesives include those known as RHOPLEX N-1031 Emulsion, RHOPLEX N-580 Emulsion, and RHOPLEX N-619 Emulsion.

In some embodiments, dry adhesives may also be used, as they may typically not require activation with water, solvent or heat, and firmly adhere to many dissimilar surfaces. Other emulsion polymers or acrylic polymer blend adhesives are also contemplated and other suitable types of adhesives and of contact adhesives can be used.

In some examples, the adhesive layer is pressure sensitive such that the adhesive layer forms an adhesive bond with a non-adhesive member when pressure is applied to the adhesive layer and the non-adhesive member. In some examples, the adhesive layer is not pressure sensitive such that the adhesive layer forms an adhesive bond with a non-adhesive member when little to no pressure is applied to the adhesive layer and the non-adhesive member, and instead, the adhesive layer contacts the non-adhesive member and a bond is formed. In an example, the adhesive layer may be in the form of a double sided tape that may be used to secure the first non-adhesive member to the second non-adhesive member.

In some embodiments, the adhesive layer includes an adhesive layer capable or configured to hold or couple two non-adhesive members together by surface attachment or interlocking action. In some examples, the adhesive layer includes a substrate with a layer of adhesive applied or bonded to at least one surface. In some examples, the adhesive layer includes a substrate with a layer of adhesive on a first surface and a layer of adhesive on a second surface, where the second surface is opposite the first surface.

In use, in an example, the adhesive layer may be secured to a first non-adhesive member through a surface attraction or interfacial force. In some examples, the first non-adhesive member may be coupled with, attached to, or form part of a stack retainer or a strip of sheet material. The adhesive layer secured to the first non-adhesive member may then be secured to a second non-adhesive member, thereby securing together the first non-adhesive member and the second non-adhesive member. In some examples, the second non-adhesive member may be an alternate or second strip of sheet material.

In some embodiments, the securement or adhesion of the first non-adhesive member and the second non-adhesive member is generally permanent, such that the first non-adhesive member and the second non-adhesive member may not be easily separated. In some embodiments, the securement or adhesion of the first non-adhesive member and the second non-adhesive member may be non-permanent, such that the first non-adhesive member and the second non-adhesive member may be easily separated.

In some examples, the connector may include an adhesive layer and a release layer. In some examples, the connector can include an adhesive layer and a substrate with a release property such that the adhesive layer may be releasably stuck to the substrate. The adhesive layer may be initially positioned adjacent the release layer to allow for the easy separation of the adhesive layer with respect to the release layer. In some examples, a connector having an adhesive layer may be positioned in a first position adjacent a release layer. In some examples, the first position may include a shipping and handling position, which is remote from the position used for splicing the sequential strips of supply material. In such examples, a user repositions the connector to a second position so that the connector may be used to splice or connect the components of two stock material units together.

In some embodiments, the bonding member includes a cohesive layer, or a combination of an adhesive layer and a cohesive layer. A cohesive, as defined herein, differs from an adhesive in that an adhesive bonds strongly, of sufficiently strongly to other materials such as the stock material to enable splicing and maintaining the splicing during feeding to and through, and conversion by, the conversion machine 102, while a cohesive bonds strongly, or sufficiently strongly for such splicing, to another cohesive of similar composition, cohesives bond weakly to other materials, including the stock material. Comparatively, cohesives bond or adhere to similar cohesives far more strongly than to other surfaces, in some embodiments including paper. Consequently, in embodiments, cohesives do not require a release layer. In some embodiments, the connector includes a cohesive instead of, or alternatively in addition to, an adhesive. While a release layer is not required with a cohesive connector embodiment, a cover, such as a cover not coated with a release layer, may still be used to protect the cohesive from contamination or damage during the shipping and handling process. A cohesive material of the connector causes one cohesive surface to stick to an opposing cohesive surface by coming into contact with the same or a complimentary cohesive substance to form the bond between the two cohesive surfaces.

Cohesives or a cohesive including a cohesive layer, as defined herein, in which opposing cohesives stick to one another, may not stick to other, non-cohesive substances sufficiently to adhere to those other substances. In some embodiments, the cohesive, which may also include a cohesive layer, does not exhibit a strong adhesion, securement, or bonding force to non-cohesive surfaces, members, or items. The cohesive does exhibit a strong adhesion, securement, or bonding force to other cohesive surfaces, members, or items.

A cohesive can be a pressure sensitive cohesive, in which pressure is required to activate the bond. Examples of a suitable cohesive material from which the cohesive layer can be made include natural and synthetic latex-based cohesives. The cohesive material in some embodiments is applied as a liquid to the appropriate portion of the connector, and in others is applied in other known forms. Some types of cohesives, such as ones made with latex, are mixed with water without additional adhesives to bond to the respective, non-cohesive, portion of the connector, such as a substrate, and upon drying remain stuck to the exposed surface of the substrate to which it has been applied.

In some embodiments, the cohesive material can be mixed with an adhesive material, for example as applied as a liquid, onto a portion of the connector. The adhesive can be selected so that after applying the cohesive and adhesive mixture onto a portion of the connector, the adhesive evaporates, leaving the cohesive bonded to the non-cohesive portion of the splice member, such as a substrate or a portion of the strip of sheet material. One method of liquid application is spraying, although brushing or other suitable methods can be used. Also, other suitable methods of applying the cohesive to the non-cohesive material surface can alternatively be used.

In some examples, surfaces of the connector that do not have a cohesive surface or other, non-cohesive surfaces of the strip of sheet material would weakly bond or stick to the cohesive layer.

In use, a cohesive layer may be secured to a non-cohesive member using a semi-permanent or permanent attachment method, such as those described above. In some embodiments, a first cohesive layer may be attached to a first non-cohesive member, such as a strip of sheet material, and a second cohesive layer may be attached to a second non-cohesive member, such as an alternate strip of sheet material. In some embodiments, a user may then couple or secure the first non-cohesive member, such as a strip of sheet material, to the second non-cohesive member, such as an alternate strip of sheet material, via contacting or joining the first cohesive layer with the second cohesive layer.

In example connectors using a cohesive layer, a non-cohesive member, such as a section or portion of a strip of sheet material, may form a protective layer over the cohesive layer when the connector is in a first position. The protective layer may help prevent the cohesive layer from contacting debris or accidental contact with other components when the connector is positioned in the first position. The protective layer may also act as a release layer so that the cohesive layer does not form a strong bond with the protective layer and may easily be separated from the protective layer when the connector is ready to be positioned in a second position. When a user or operator is ready to position the connector in the second position, for example to daisy chain material together, the protective layer or cover may be easily removed or separated from the cohesive layer so that the cohesive layer is exposed and ready to be joined with another cohesive layer.

A first example of a stock material unit will now be described. In some embodiments, a stock material unit includes a strip of sheet material, a splice member including a connector, and a stack retainer. In some embodiments, a stock material unit includes a strip of sheet material and a splice member including a connector. The stock material unit can include a supply unit that has a strip of sheet material in a high-density configuration. Some embodiments of the stock material unit include a stack retainer that retains the stock material in the high-density configuration. The stock material unit can include a splice member releasably stuck to the supply unit. The splice member having a connector with a bonding material that can stick to the end of another supply unit to daisy chain the stock material. In some embodiments, multiple strips of sheet material may be daisy chained to form a continuous stream of material to feed into and through the converting machine.

FIGS. 3A-3E illustrate various folds of a stock material unit 300, including showing steps or method acts for how at least a portion of the continuous sheet material may be folded, according to an embodiment.

Figure 3A:
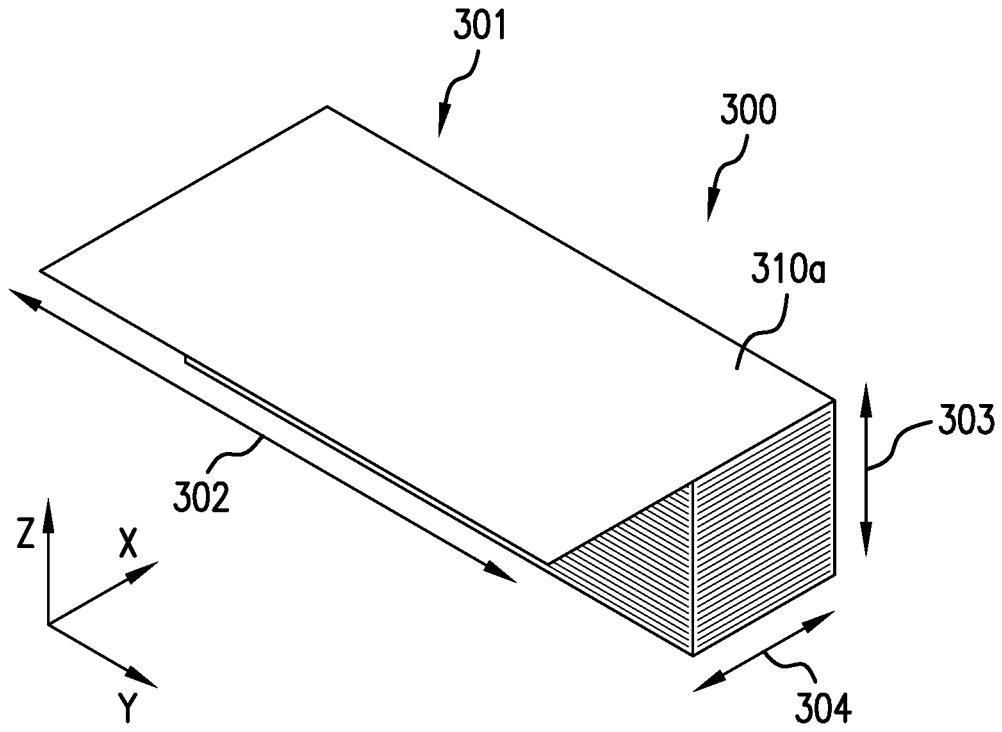
FIGS. 3A-3E are perspective views of an embodiment of a folded stock material unit for a dunnage conversion machine, illustrating different steps involved in folding a sheet of the stock material unit.

As shown in FIG. 3A, the stock material unit 300 may include a fan folded strip of sheet material 301 that defines a three-dimensional body that has longitudinal, transverse, and vertical dimensions 304, 302, 303 that correspond to the longitudinal, transverse, and vertical directions of the strip of sheet material 301 of the stock material unit 300. For ease of description, axes X, Y, and Z are identified on FIG. 3A and correspond to the orientation of a strip of sheet material 301 from which the stock material unit 300 may be formed as well as to the longitudinal, transverse, and vertical directions. Specifically, X-axis corresponds to the longitudinal direction of the strip of sheet material (e.g., feed direction) and to the longitudinal dimension 304 of the strip of sheet material 301 of the stock material unit 300; Y-axis corresponds to the transverse direction of the strip of sheet material 301 and to the transverse dimension 302 of the strip of sheet material 301 of the stock material unit 300.

Moreover, the vertical dimension 303 defines the height of the strip of sheet material 301 of stock material unit 300, which is formed when the continuous sheet is folded repeatedly in alternating directions to form multiple adjacent sections that stack together; the Z-axis is parallel to the vertical dimension 303.

Folding the strip of sheet material 301 at the transverse fold lines forms or defines generally rectangular sheet sections, such as sheet section 310. The rectangular sheet sections may stack together (e.g., by folding the strip of sheet material in alternating directions) to form the three-dimensional body that has longitudinal, transverse, and vertical dimensions 304, 302, 303. Moreover, at least a portion of the strip of sheet material 301 may be folded about fold lines that are slanted relative to the transverse and/or longitudinal dimensions of the continuous sheet (e.g., non-parallel relative to the X-axis and Y-axis).

For example, a portion 310 may be larger (e.g., wider) than the width or longitudinal dimension of the three-dimensional body of the strip of sheet material 301. In some examples, the portion 310 may be similar to the width or longitudinal dimension of the three-dimensional body of the strip of sheet material 301. In some examples, a connector may be connected or attached to the section 310 to daisy chain the strip of sheet material 301 to an alternate strip of sheet material.

Figure 3B:
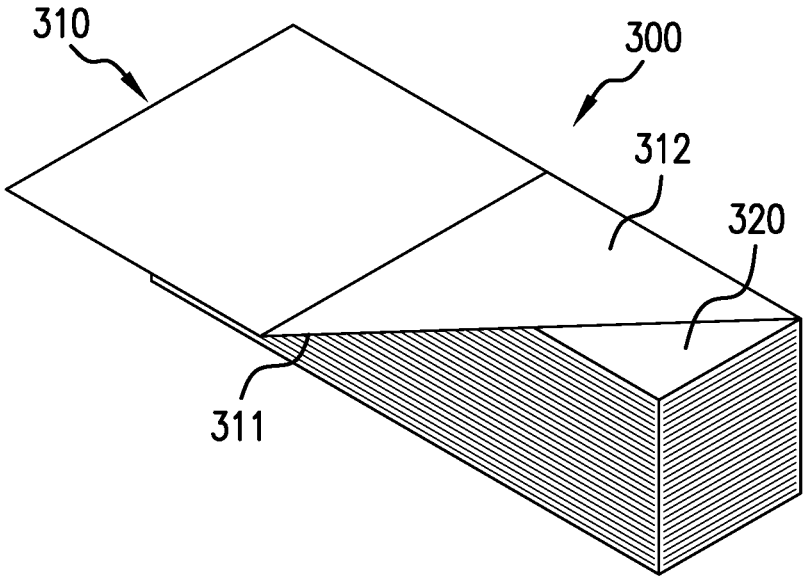

In some examples, the strip of sheet material 301 may be further folded. As shown in FIG. 3B, part of the portion 310 may be folded along a slanted fold line 311 to form a section 312. Specifically, for example, the slanted fold line 311 has a non-parallel orientation relative to the transverse and longitudinal directions of the strip of sheet material 301 of the stock material unit 300. Moreover, folding part of the portion 310 to form the section 312 may expose the underlying section 320 of the strip of sheet material 301.

Figure 3C:
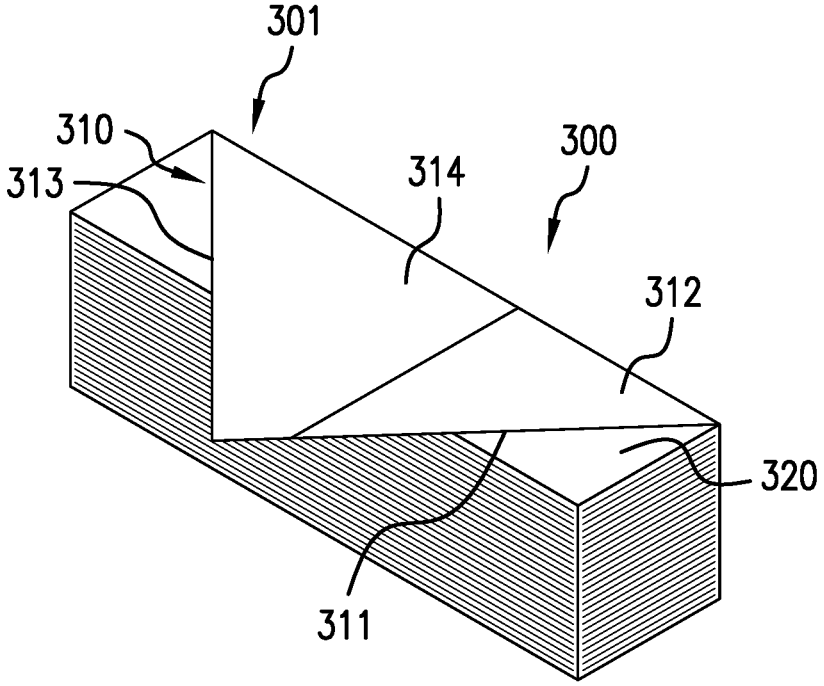
Figure 3D:
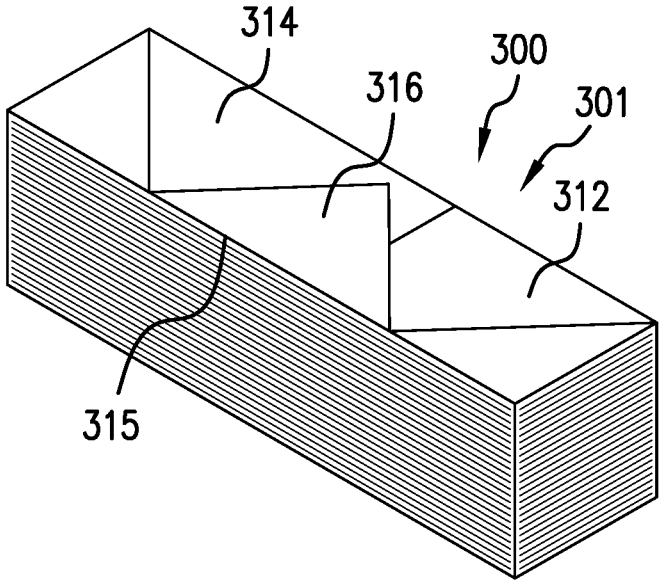
Figure 3E:
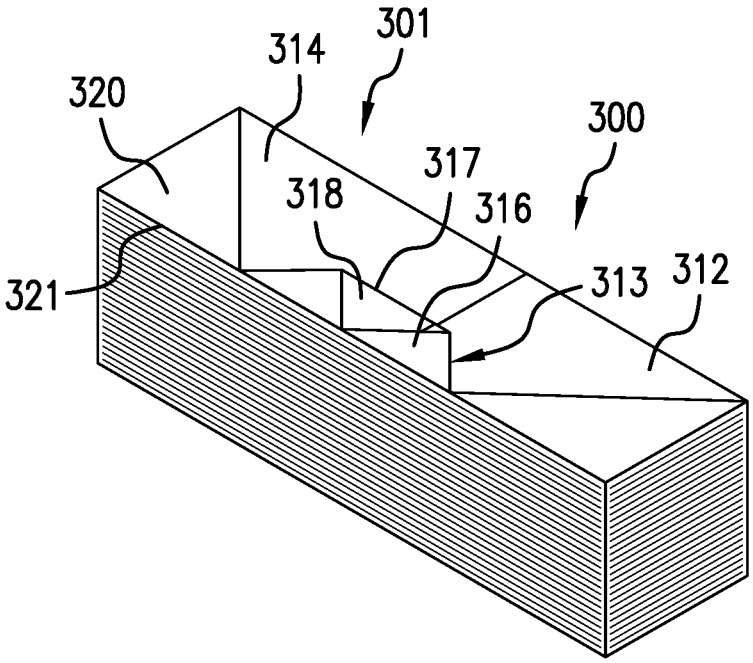

As shown in FIG. 3C, part of the portion 310 may be folded along another slanted fold line 313 to form section 314. Collectively, sections 312 and 314 form a triangular section or portion of the stock material unit 300. The section 314 can be larger than the section 312. Moreover, the peak of the triangular section formed or defined by sections 312 and 314 may be approximately at the center of the transverse dimension of the strip of sheet material 301. For example, folding part of the portion 310 along the fold line 313 may also include folding a portion of the section 312 onto another portion of the section 312. Hence, for example, near the tip, the triangular section formed by sections 312 and 314 may include more folds than at the base thereof (e.g., near the tip, where sections 312 and 314 overlap, there may be four layers, and near the base of the triangular section there may be two layers).

Moreover, a portion of the triangular section that is formed by the sections 312 and 314 about a transverse fold line 315 to form a smaller triangular section 316. For example, the triangular section 316 may be folded over the sections 312 and 314. Moreover, at least a portion of the triangular section 316 may be attached to a portion of a sheet of another stock material unit. Hence, for example, additional layers of the strip of sheet material 301 at the portion of the triangular section 316 may reinforce the portion of the triangular section 316 that may attach to a portion of an alternate strip of sheet material of another stock material unit. Thus, a first end of the strip of sheet material can have a narrowed portion that is narrower than a main portion of the strip of material.

Figure 3F:
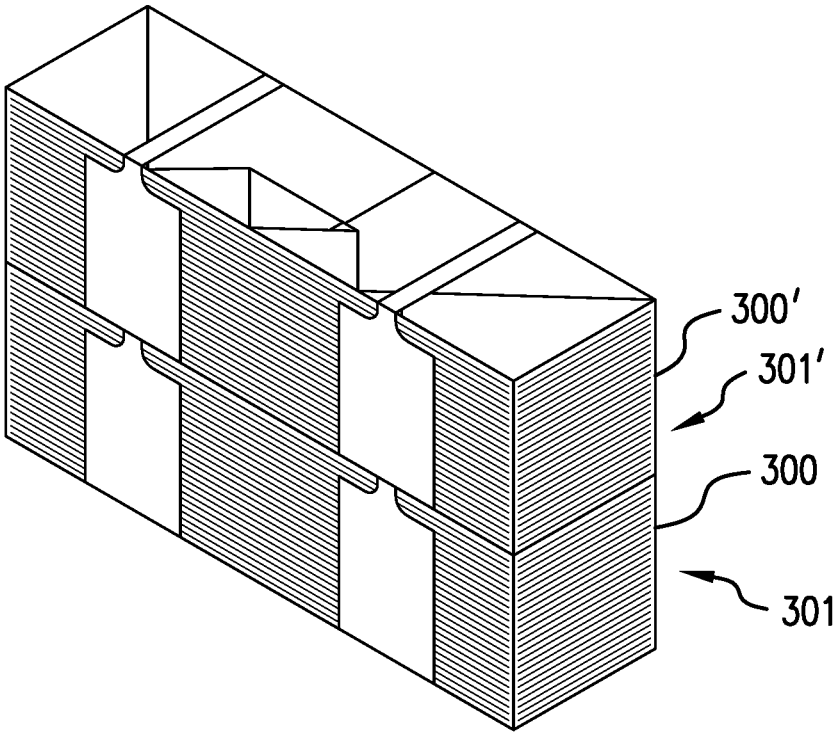
FIG. 3F is a perspective view of an embodiment of two folded stock material units of FIG. 3A stacked and bound with a stack retainer.

As shown in FIG. 3F, a second stock material unit 300' may be placed on top of the stock material unit 300, such that the bottom section and/or portion of the strip of sheet material 301' of the second stock material unit 300' contacts a splicing feature of stock material unit 300 to daisy chain or secure the strip of sheet material 301 of the stock material unit 300 to the strip of sheet material 301' of the second stock material unit 300'. In this manner, multiple strips of sheet material of multiple stock material units may be daisy chained or secured together using splicing features so that a continuous stream of material may be supplied to the dunnage converting machine.

For example, each stock material unit may include at least one splice member including a connector. In some examples, in a first position, the connector is connected or attached to the strip of sheet material. In some examples, in a first position, the connector is connected or attached to the stack retainer. In some examples, regardless of the position of the connector in the first position, in a second position, the connector daisy chains a first end of the strip of sheet material 301 of the stock material unit 300 to a second end of an alternate or second strip of sheet material 301' of a second stock material unit 300'.

Various examples and features of a stack retainer will now be described. In some embodiments, a stack retainer, such as strap or wrapping member or sheet, may be used to help position or secure the folded strip of sheet material (e.g., to prevent unfolding or expansion and/or to maintain the three-dimensional shape thereof). For example, the stack retainer may wrap around the three-dimensional body of the strip of sheet material, thereby securing together the multiple layers or sections (e.g., formed by accordion-like folds). The stack retainer may facilitate storage and/or transfer of the strip of sheet material of the stock material unit (e.g., by maintaining the strip in the folded and/or compressed configuration).

For example, when the stock material unit is stored and/or transported, the stack retainer may wrap or surround at least a portion of the three-dimensional body of the strip of sheet material and/or compress together the layers or sections of the strip of sheet material that defines the three-dimensional body and reduce the size thereof. Moreover, compressing together the sections of the strip of sheet material may increase rigidity and/or stiffness of the three-dimensional body and/or may reduce or eliminate damaging the strip of sheet material during storage and/or transportation of the stock material unit.

Figure 4A:
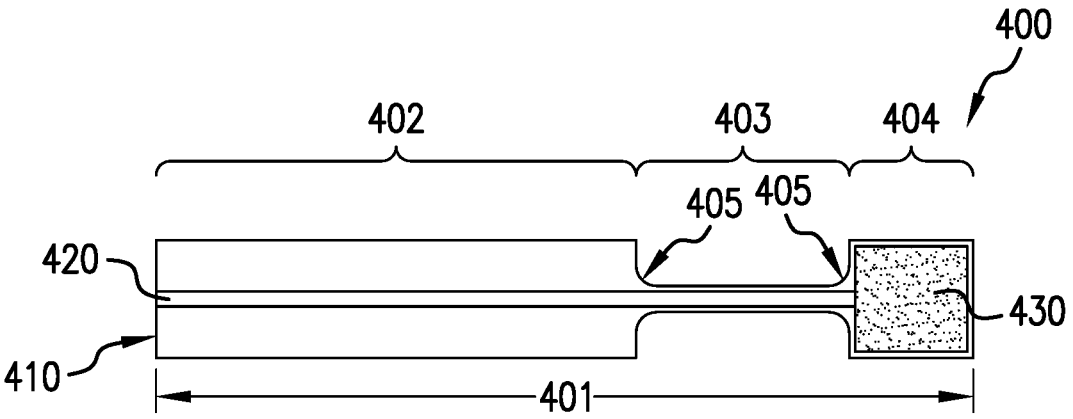
FIG. 4A is a top view of an embodiment of a stack retainer in an unwrapped configuration.
Figure 4B:
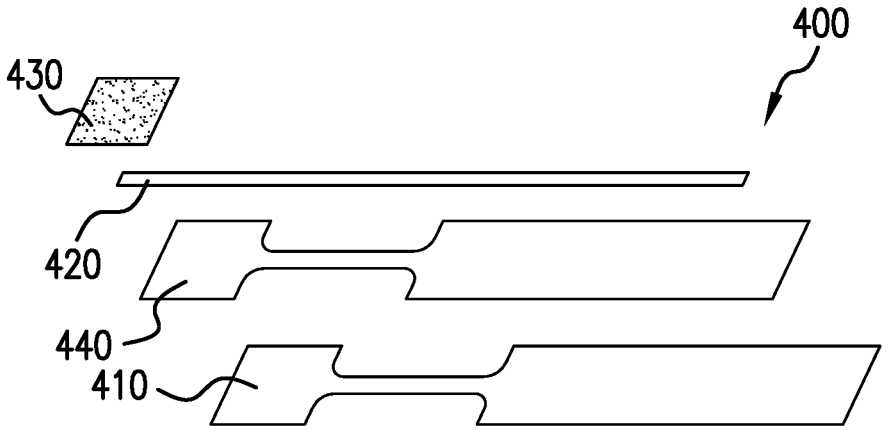
FIG. 4B is an exploded, perspective view of an embodiment of the stack retainer of FIG. 4A.
Figure 4C:
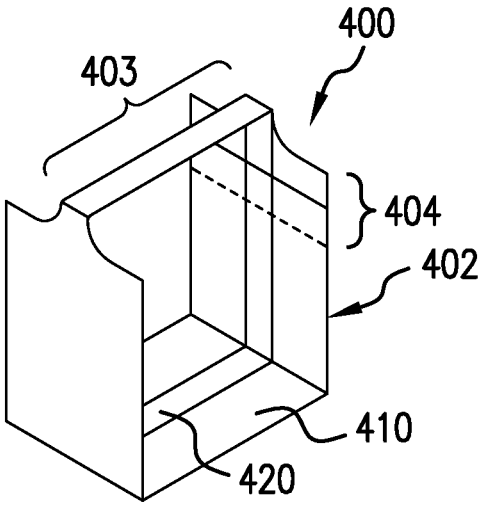
FIG. 4C is a perspective view of an embodiment of the stack retainer of FIG. 4A in a wrapped configuration.

In some embodiments, the stack retainer may surround at least a portion of the strip of sheet material, thereby forming a strap, such as strap 400 of FIGS. 4A-4C. In some embodiments, at least two stack retainers may be used with a single strip of sheet material to form an individual stock material unit. While most of the fanfolded material remains exposed from the straps in the embodiments shown, in some examples, the stack retainer may generally surround the entire strip of sheet material, to form an enclosed package. In the examples, the stack retainers may be formed using thin strips so that most of the folded strip of material is exposed. Prior to use, the stack retainer may be removed or separated from the strip of sheet material.

Examples of an embodiment of a stack retainer, such as a strap assembly 400, are shown in FIGS. 4A-4C. The strap assemblies 400 may facilitate the handling of the stock material unit, such as a stock material unit 300. For example, the strap assemblies 400 may include a wider portion 402 and a narrower portion 403. The narrower portion 403 may be suitably sized and/or shaped to facilitate gripping thereof by a user or operator. The wider portion 402 may facilitate securing and/or supporting the weight of the stock material unit. For example, the weight of the stock material unit may be distributed over one or more wider sections of the corresponding strap assemblies 400, which may reduce or avoid damaging and/or ripping the strip of sheet material of the stock material unit 300. In some examples, the strap assemblies may have a generally constant width or size.

As described above, the stack of fanfold material may be wrapped or bundled by one or more straps that may compress and/or secure together sections of the fanfold material (e.g., to securely form a three-dimensional body). FIGS. 4A-4B illustrate the strap assembly 400 in an unwrapped configuration. Specifically, FIG. 4A is the top view of the strap assembly 400, and FIG. 4B is a perspective, exploded view of the strap assembly 400.

The strap assembly 400 includes a base sheet 410, a reinforcement member 420, and an adhesive 430. As described below in more detail, the adhesive 430 or other connecting element may secure opposing ends of the strap assembly 400 to reconfigure the strap assembly 400 from the unwrapped into wrapped configuration. The strap assembly 400 includes a laminate layer 540. The strap assembly can include only one or a different numbers of layers. For example, the strap assembly have only a base sheet or a base sheet and a bonding element such as an adhesive or cohesive.

The strap assembly 400 is relatively thin or sheet-like. The strap assembly 400 has an elongated shape. For example, longitudinal dimension 401 of the strap assembly 400 may be greater than a transverse direction thereof (e.g., measured along a direction that is perpendicular to the longitudinal dimension). The longitudinal dimension 401 is suitable to facilitate wrapping the strap assembly 400 about a fanfold stack (such as a strip of sheet material as described above) or about any other material stack or roll and to secured the portion of the strap assembly 400 that includes the adhesive 430 to an opposing portion of the strap assembly 400.

The adhesive 430 may be generally located at or near a first end of the strap assembly 400. The strap assembly 400 may be wrapped or looped, such that the first end of the strap assembly 400, which has the adhesive 430, is positioned over at least a portion of the second end of the strap assembly 400. Moreover, the adhesive 430 may secure together the first and second ends of the strap assembly 400, to suitably secure the material about which the strap assembly 400 is wrapped. For example, wrapping the strap assembly 400 may include adjusting the strap assembly 400 to a suitable size and/or to have a suitable tension against the three-dimensional body wrapped thereby (e.g., to suitably compress the three-dimensional body of the strip of sheet material).

The transverse dimension of the strap assembly 400 may vary along the longitudinal direction of the strap assembly 400. For example, as shown in FIGS. 4A-4B, the strap assembly 400 has a first portion 402 that extends longitudinally from and defines the first end of the strap assembly 400; a second portion 403 that extends longitudinally from the first portion 402, and a third portion 404 that extends from the second portion 403 and defines the end of the strap assembly 400. Hence, for example, the second portion 402 is located between the first and third portions 402, 404.

The second portion 403 is narrower than the first and third portions 402, 404 such that the transverse dimension of the second portion 403 is smaller than transverse dimensions of the first and third portions 402, 404. It should be appreciated that the ratio of the width or transverse direction of the second portion 403 to the width or transverse dimension of the first and/or third portions 402, 404 may be greater than 1:1.1 or less than 1:10.

The second or narrower section 403 is sized to facilitate gripping or grasping by an operator. For example, as described below in more detail, when the strap assembly 400 is reconfigured into a wrapped configuration, the second section 403 may be suitably exposed or available to the operator or user, such that the operator or user may grasp the strap assembly 400 at the second section 403 (e.g., the second section may form or define a handle, when the strap assembly 400 is in the wrapped configuration).

The periphery or perimeter of the strap assembly 400 may be defined by the edges that define the first section or wide portion 402, second section or narrow portion 403, and third section or wide portion 404. The strap assembly 400 includes fillets 405 that may define at least a portion of the transition between the first section 402 and the second section 403 and/or between the third section 404 and the second section 403. Hence, for example, the periphery of the strap assembly 400 may be also defined by the fillets 405.

Generally, the base sheet 410, reinforcement member 420, and laminate layer 540 of the strap assembly 400 may include any number of suitable materials. For example, the base sheet 410 may include a suitable sheet material, such as paper, plastic sheet, cardboard, etc. (e.g., the base sheet 410 may include Kraft paper). The reinforcement member 420 may include any number of suitable materials that may suitably reinforce the base sheet 410 to facilitate handling or carrying of the material secured or wrapped by the strap assembly 400 (e.g., by grasping the second section 403 when the strap assembly 400 is in the wrapped configuration). For example, the reinforcement member 420 may include a fiber reinforced tape or sheet that may be secured to the base sheet 410.

The reinforcement member 420 may be directly secured to the base sheet 410 (e.g., by adhering or bonding or mechanically securing the reinforcement member 420 directly to the base sheet 410). Alternatively, the reinforcement member 420 may be indirectly secured to the base sheet 410. For example, one or more intervening members may be secured between the reinforcement member 420 and the base sheet 410. Furthermore, the reinforcement member 420 may be substantially and continuously secured to the base sheet 410. For example, the suitable portion of the surface area of the reinforcement member 420 may be secured to the base sheet 410. Moreover, a suitable length of the reinforcement member 420 may be secured to the base sheet 410. In the illustrated embodiment, the laminate layer 540 is located between the base sheet 410 and the reinforcement member 420.

The laminate layer 540 may include any number of suitable materials that may be attached to the base sheet 410 (e.g., bonded or mechanically secured). The adhesive 430 may be any suitable adhesive, including a pressure sensitive adhesive.

FIG. 4C illustrates an example of the strap assembly 400 in the wrapped configuration. For example, as shown in FIG. 4C, the third portion 404 of the strap assembly 400 is secured to the first section or portion 402 of the strap assembly 400 (e.g., opposing ends of the strap assembly 400 are secured together). Moreover, the second section or portion 403 is positioned at the top, such as to form a handle for the strip of sheet material of the stack material unit wrapped by the strap assembly 400. The base sheet 410 may have a first face oriented to face outward (e.g., such that the reinforcement member 420 is concealed by the base sheet 410, when the strap assembly 400 is wrapped about the three-dimensional body of the strip of sheet material). For example, the reinforcement member 420 may be concealed between the three-dimensional body and the base sheet 410. Alternatively, the strap assembly 400 may be wrapped in the manner that the reinforcement member 420 faces outward or defines at least a portion of an outward facing side or face of the strap assembly 400.

The strap assembly 400 may be wrapped about a material stack of a strip of sheet material that defines a three-dimensional body with a generally rectangular cross-section (e.g., the strap assembly 400 may at least partially conform to the outer shape of the material stack). For example, as shown in FIG. 3F, a stock material unit 300 or a stock material unit 300' may include a fanfold material stack of a strip of sheet material that defines the three-dimensional body thereof and two strap assemblies 400 that secure together multiple sections of the fanfold. It should be appreciated, however, that the strap may conform to any number of suitable shapes (e.g., round, polygonal, irregular). Furthermore, as shown in FIG. 3F and explained in detail below, the strap assemblies 400 may wrap about the three-dimensional body of the strip of sheet material such that one, some, or each of the strap assemblies 400 contact four peripheral surfaces of the three-dimensional body (e.g., the strap assemblies 400 may secure the strip of sheet material that defines the three-dimensional body without additional devices or elements).

After the strap assemblies 400 are wrapped about the three-dimensional body of the strip of sheet material of the stock material unit, the second portion 403 of each of the strap assemblies 400 (which is narrower than the remaining portions of the strap assemblies 400) may be accessible to a user or operator for grasping. For example, as shown in FIG. 3F, the second portion 403 of each of the strap assemblies 400 may span across a peripheral face of the three-dimensional body of the strip of sheet material of the stock material unit 300 or 300'. For example, the second portion 403 may span across the top face of the three-dimensional body of the strip of sheet material in the longitudinal direction. In an example, the second portion 403 of each of the strap assemblies 400 may form or define corresponding handles that may be grasped by a user or operator for lifting and/or carrying the stock material unit 300.

The strap assemblies 400 may be spaced from each other along a transverse direction of the three-dimensional body of the strip of sheet material of the stock material unit 300. For example, the strap assemblies may be spaced from each other such that the center of gravity of the three-dimensional body of the strip of sheet material is located between two strap assemblies 400. Optionally, the strap assemblies 400 may be equidistantly spaced from the center of gravity of the three-dimensional body of the strip of sheet material.

As described above, the stock material unit 300 may be placed into a dunnage conversion machine. Additionally or alternatively, multiple stock material units (e.g., similar to or the same as the stock material unit 300) may be stacked on top of one another in the dunnage conversion machine. The stock material unit may include one or more strap assemblies 400 and a strip of sheet material. For example, the strap assemblies 400 may remain wrapped about the strip of sheet material after placement and may be removed thereafter (e.g., the strap assemblies 400 may be cut at one or more suitable locations and pulled out). The strap assembly 400 can be sufficiently strong to carry the strip of sheet material in a high density configuration and also be sufficiently weak to be torn, for example by hand, and removed from the strip of sheet material after loading the strip of sheet material in a conversion machine.

The narrower portion of the strap assembly may have any suitable length and/or may wrap about any portion of the stock material. As shown in FIG. 3F, for example, strap assemblies 400 may secure the strip of sheet material of the stock material unit 300. As shown in the example of FIG. 3F, the narrower portion 403 of the strap assembly 400 may extend over two or more surfaces or faces of the three-dimensional body of the strip of sheet material. For example, the strap assembly 400 may include a portion 402 that extends along a portion of a face of the three-dimensional body, and the narrower portion 403 may extend along another portion of the same face as well as along a portion or an entire width (or length) of another face of the three-dimensional body. For example, a user or operator may have access to the narrower portion 403, which may facilitate removal of the strap assembly 400. In some examples, the narrow portion 403 may be severed.

The portion 403 may extend along the front face of the three-dimensional body of the strip of sheet material by any suitable distance. Generally, the strap assemblies 400 may be positioned at any number of suitable locations along the transverse dimension of the strip of sheet material to help form the stock material unit 300. It should be appreciated, however, that the stock material unit may include any number of strap assemblies 400 that may be located or positioned at any number of suitable locations, in the manner that secures together the folds or sections of the strip of sheet material. Moreover, in some examples, the stock material unit 300 may not include straps.

Furthermore, it should be appreciated that, generally, the three-dimensional body of the strip of sheet material of any of the stock material units described herein may be, stored, transported, used in a dunnage conversion machine, or combinations thereof without any stack retainer such as wrapping or strapping, or with a different stack retainer than the strap assembly 400 (FIGS. 4A-4C). For example, other straps such as a twine, rope, or other suitable strapping material can be used as a stack retainer to secure the three-dimensional body of a strip of sheet material in a supply unit or stock material unit. Paper, shrink-wrap, and other suitable wrapping material may be used as a stack retainer to secure together one or more sheets that define the three-dimensional body of any of the strip of sheet material of the stock material unit described herein. Similarly, the above-described method and structure of supporting the three-dimensional body of the strip of sheet material of the stock material unit may facilitate wrapping the three-dimensional body with any number of suitable wrapping or strapping materials and/or devices.

Various embodiments of splice members to combine, connect, couple, or daisy chain multiple continuous sheets of material of stock material units together will now be described.

A splice member may include a base and a connector. In some embodiments, the base may secure the connector to one or more portions of the strip of sheet material of the stock material unit, for example stock material unit, and the connector may connect together or daisy-chain two stock material units, for example stock material unit 300 and stock material unit 300', so that the strip of sheet material therefrom may form a continuous sheet of material that is continuously fed into to the dunnage conversion machine. In an embodiment, the base is larger or has a larger area than the connector. For example, providing the base with a larger surface area than the connector may facilitate removal of the base from the connector. The base can be permanently stuck to the supply unit, such as to the strap.

In some embodiments, the base may include multiple layers. For example, the base may include a base substrate, a base adhesive layer extending over at least a portion of a first side or face of the base substrate, and a release layer extending over at least a portion of a second, opposite side or face of the base substrate. The connector may include a connector substrate and a connector adhesive layer extending over at least a portion of a first side or face of the connector substrate, such as a second, opposite side of the connector substrate and may form or define an outer surface or cover the connector.

In some examples, the connector adhesive layer may include pressure-sensitive adhesive (for example, the connector may be pressed against the strip of sheet material of a stock material unit in the manner that activates and/or attaches the adhesive layer to the strip of sheet material).

As mentioned above, the base 410 may be larger than the connector. In some examples, the connector or splice member may define a generally butterfly-shaped, heart shaped, square, rectangle, circular, oval, oblong, or other suitable shape. In some examples, the connector or splice member may have an asymmetrical shape. For example, the connector or splice member may have a shape that is asymmetric about a longitudinal and/or transverse axis thereof. For example, the connector or splice member may have an asymmetrical shape about a first axis and a symmetrical shape about another, perpendicular axis. Moreover, opposing portions of the splice member may be asymmetrical about an axis that is perpendicular to another axis (for example, where the perpendicular axis extends through the center of the splice member).

An embodiment of a stock material unit 500 is shown in FIGS. 5A-5F, which may include features similar or different than previously described stock material units. For example, with reference to FIGS. 5A-5F, various features of the stock material unit, such as the stock material unit 300 described in FIG. 3E, may be used in combination with the splice member to help secure or daisy chain a strip of sheet material of a first stock material unit to the strip of sheet material of another stock material unit to help form a continuous stream of material for use in a dunnage conversion machine.

With reference to the strip of sheet material 501 of stock material unit 500, the triangular section 516 may be secured to the sections 512 and 514 (e.g., to facilitate storage and/or transportation of the stock material unit 500). For example, portions of a splice member may secure the triangular section 516 to the sections 512 and 514.

Figure 5A:
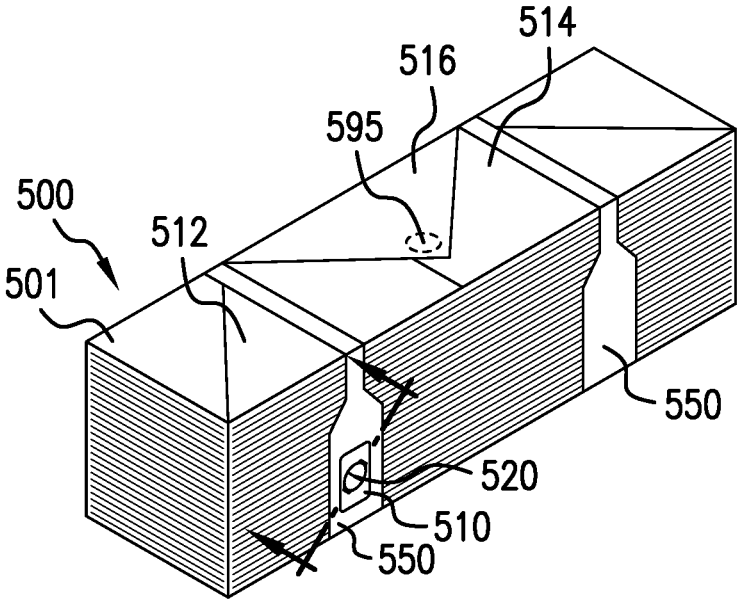
FIG. 5A is a perspective view of an embodiment of a stock material unit.

As shown in FIG. 5A, stack retainers such as strap assemblies 550 may be positioned relative to the section 516 in a manner that allows folding of the section 516, as described above.

The embodiment of FIGS. 5A-5F includes the stock material unit 500 and splice member, such as splice member 540. The splice member includes a connector with a bonding member for bonding sequential ends of the stock material strips together to couple them and feed them into the converting station as a continuous stream of material. The splice member includes a connector including a substrate with a bonding member disposed on one or more surfaces of the substrate. For example, a substrate can have one bonding member on a first surface, and another bonding member on an opposing surface. A bonding member can enclose or encapsulate a substrate. The splice member can include a connector with a bonding member without a substrate. The bonding member can be provided as a layer or in other suitable configurations on the substrate. The bonding member can include an adhesive, a cohesive, or a combination of adhesives and cohesives. An adhesive may include an adhesive layer. An adhesive as defined herein, may be used to secure two non-adhesive members together. The adhesive may adhere to other types of surface or materials. Examples of adhesives include liquid adhesives, tapes, and pressure sensitive adhesives.

The splice member 540 includes a base, such as base 510 and a connector, such as connector 520. In use, the connector may be used to connect or splice the strip of sheet material of stock material unit to other strips of sheet material of other stock material units to form a continuous stream of material that may be fed into the dunnage converter machine. The connector includes a bonding member that is used to help splice strips of sheet material together. In the example of FIGS. 5A-5F, the bonding member of the connector 520 is an adhesive. However, in other examples, other species of bonding members, such as a cohesive, may be used. In use, the base 510 may be used to position and protect the connector 520 during transportation of the stock material unit 500. In some examples, the splice member does not include the base.

In the example of FIG. 5A, the base 510 may include a base substrate layer 511 positioned between bonding elements such as base adhesive layer 512 and a base release layer 513. The connector 520 may include a connector substrate 521, a connecting portion 531, a cover 528, and a cover release layer 526 configure to allow the cover 528 to be releasably stuck to the bonding element. The connecting portion 531 can include one or more connecting surfaces, such as a connector adhesive layer 522, and/or a second connector adhesive layer 529.

In a first position, such as FIG. 5A when the stock material unit 500 is being handled and prior to being loaded into the dunnage conversion machine and coupled with an alternate second stock material unit, the splice member 540 is secured to the stack retainer, such as a strap assembly 550.

Figure 5B:
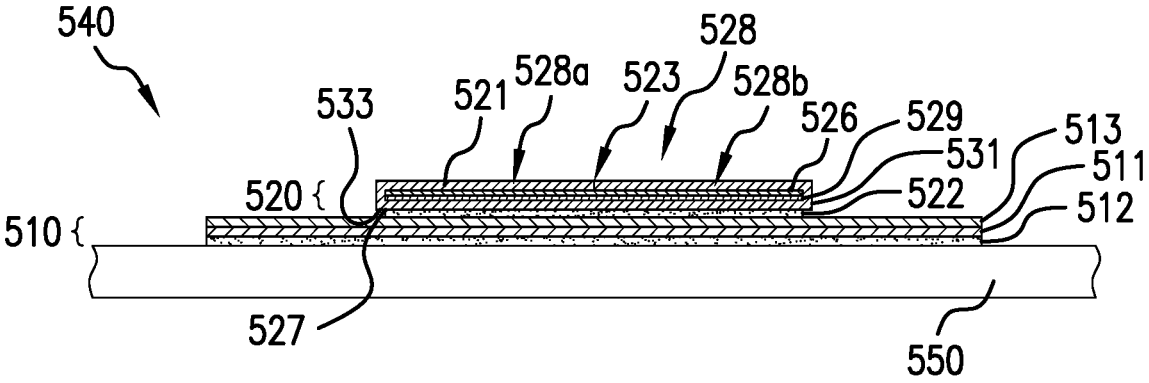
FIG. 5B is a cross-sectional view of a connector of the stock material unit of FIG. 5A.
Figure 5C:
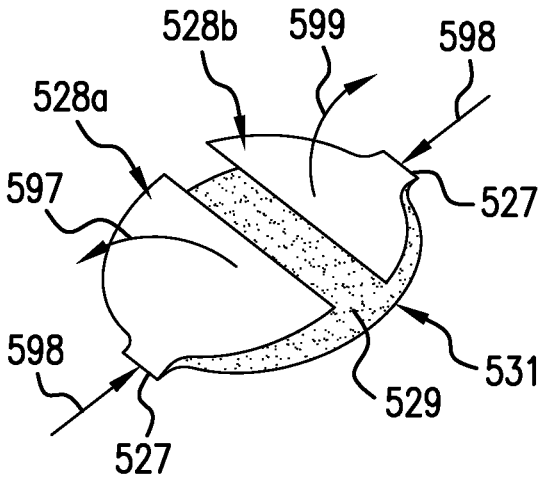
FIG. 5C is a perspective view of a connector of the stock material unit of FIG. 5A transitioning from a connector closed position to a connector open position.
Figure 5D:
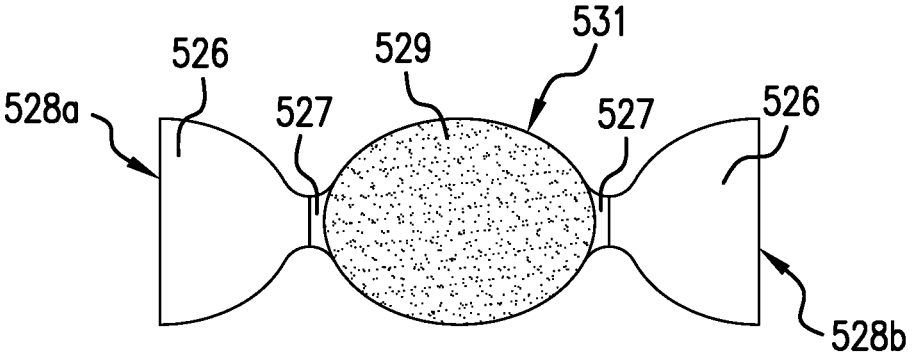
FIG. 5D is a top view of the connector of FIG. 5C positioned in the open position.
Figure 5E:
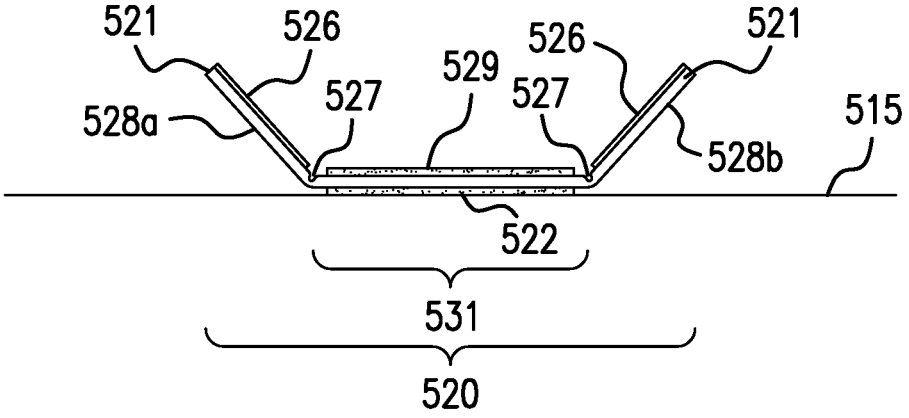
FIG. 5E is a side view of the connector of the stock material unit of FIG. 5A transitioning from a closed position to an open position.

FIG. 5B is a cross-sectional view of a splice member of the stock material unit of FIG. 5A. In this first position, the surface of the strap assembly 550 is adjacent the base adhesive layer 512 of the base 510 of the splice member 540. In some examples, the splice member 540 does not include a base 510 and the surface of the strap assembly 550 may include a release coating or layer to help the connector 520 be more readily separated from the strap assembly 550 when a user is ready to remove the splice member 540 from the strap assembly 550 and reposition the splice member 540 in a second position, such as that shown in FIG. 5F.

As shown in FIG. 5B, a connecting portion 531 of connector 520 may include the connector substrate 521 positioned adjacent to a bonding element. For example, a connector substrate 521 can be positioned between the connector adhesive layer 522 and a second connector adhesive layer 529. In some examples, the connecting portion 531 may be used to permanently position the connector 520 at a desired location on the strip of sheet material 501. The connecting portion 531 can be used to connect one stock material unit to another stock material unit, for example by first connector adhesive layer 522, and/or a second connector adhesive layer 529.

In a first position, as shown in FIG. 5B, a portion of the connector substrate 521 forms an outer surface of a cover 528, thereby forming an outer surface of the splice member 540, and the base adhesive layer 512 forms an inner surface of the splice member 540 that is positioned adjacent the strap 550. The cover 528 may define a portion of the connector substrate 521 opposite the connecting portion 531, and a split or separation line 523 extends across the cover 528 to form two flaps **528*a* 528*b*. The split or separation line 523 is centrally located on the connector substrate 521**.

The cover flaps **528*a*, 528*b* may be connected to the connecting portion 531 by a hinge 527, formed at opposite ends of the connecting portion 531 of the connector 520. In some examples, the hinges may be made from folding or score lines. In some examples, the cover flaps 528*a*, 528*b* are made from a material that is stiff enough so that when it is pinched, the cover flaps "pop" open. Examples of such stiff materials can include paper or appropriate thickness, cardboard, plastic, or other suitable materials. A cover release layer 526 forms an underside of the cover flaps 528*a*, 528*b*, as shown in FIG. 5B. In some examples, the separation line 523 extends down the general middle of the cover 528 of the connector 520 so that the cover flaps 528*a*, 528*b* are generally the same size. In other examples, the separation line may be offset and the cover flaps are not generally the same size. In other examples, the cover 528 is not split and the connector 520 uses a single hinge to connect the cover 528 to the connecting portion 531; in such examples, the cover 528 forms a flap that may be lifted off or separated from the second connector adhesive layer 529. In the example of FIGS. 5A-5F, the cover 528** may be somewhat circular. In other examples, the cover may be a variety of shapes, such as a butterfly, heart, rectangle, triangle, oval, rounded, polygonal, oblong or other suitable shape.

When a user or operator is ready to connect a first end of the strip of sheet material 501 of the stock material unit 500 to a second end of an alternate of strip of sheet material of an alternate stock material unit, the user may place the stock material unit 500 in the stack carrier or other holding mechanism to feed into the converting machine. The user may detach the connector 520 from the base 510 by separating the connector adhesive layer 522 from the base release layer 513. In some examples, the connector 520 includes an overhang 533 to help facilitate separating or lifting the connector 520 from the base 510. The overhang 533 may include a non-adhesive section to help protect a user or operator from accidentally adhering the connector 520 to their fingers or from contaminating the connector adhesive layer 522 when it is separated from the base 510.

Once separated from the base 510, the connector adhesive layer 522 is then exposed. The user may then bend or deform the connector 520 by gently squeezing it with his or her fingers in the direction of arrows 598 in FIG. 5C, so that the connector 520 becomes concave on its bottom side formed by the connector adhesive layer 522, opposite the cover flaps 528*a*, 528*b* and convex on the second connector adhesive layer 529, the side that was facing the flaps 528*a*, 528*b*, to bring the hinges 527 of the connector 520 towards each other. This bending movement causes the separation of the flaps 528*a*, 528*b* from the connector adhesive layer 529, via the cover release layer 526, in the direction of arrows 597, 599 shown in FIGS. 5C, 5D, and 5E. The flaps 528*a*, 528*b* may "pop" or open outward about hinges 527, thereby exposing the second connector adhesive layer 529.

Figure 5F:
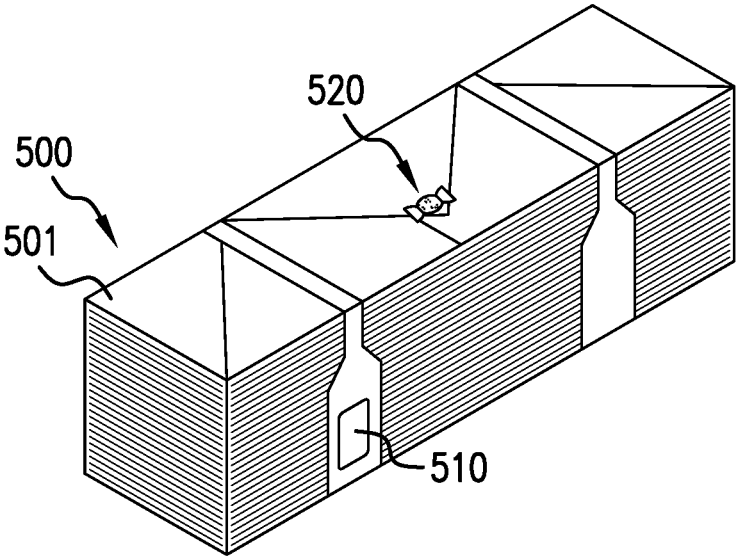
FIG. 5F is a perspective view of the stock material unit of FIG. 5A with the connector positioned in a second position.

When the cover flaps 528*a*, 528*b* are transitioning into or are in the open position, as shown in FIGS. 5C-5F, the connector adhesive layer 522 of the connector 520 may be positioned adjacent a surface of the strip of sheet material 501, such as sections 512, 514, 516 or combinations thereof, as shown in FIG. 5F, to permanently secure the connector 520 to the strip of sheet material 501. In some examples, the strip of sheet material 501 includes an optional printed target 595 (shown for example in FIG. 5A) to help the user align the connector 520 in a correct position. Once positioned, the exposed second connector adhesive layer 529 may then be used to connect a second end of an alternate strip of sheet material of an alternate stock material unit to the first end of the strip of sheet material 501 of the stock material unit 500.

In other examples, a connector similar to 520 with flaps 528*a*, 528*b* can be used, in which the bonding member is a cohesive, unlike the connector adhesive layer 529 used in FIGS. 5A-5F. The flaps 528*a*, 528*b* can be provided without a release layer as they would still be easily separable from the cohesive.

Figure 5G:
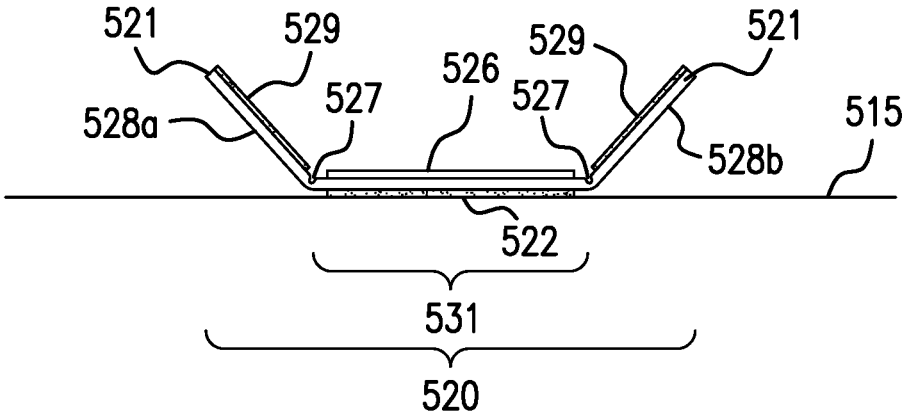
FIG. 5G is a side view of an embodiment of a connector of the stock material unit of FIG. 5A transitioning from a closed position to an open position.

As shown in FIG. 5G, a connector similar to 520 with flaps 528*a*, 528*b* can be used, where the bonding element 529 is disposed on one or both flaps 528*a*, 528*b*, and a release layer or a layer with a release property is disposed on all or a portion of a central portion of a connector substrate 521. The connection portion 531 extends across the substrate 521.

Figure 6A:
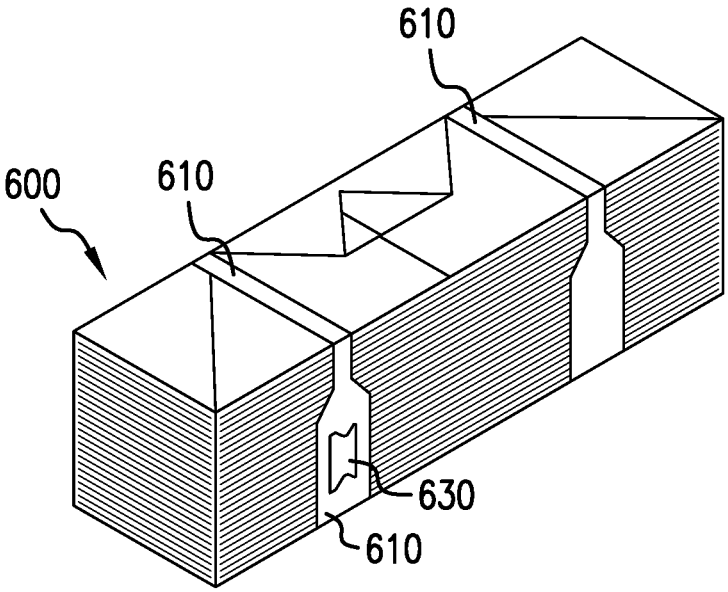
FIG. 6A is a perspective view of an embodiment of a stock material unit.
Figure 6B:
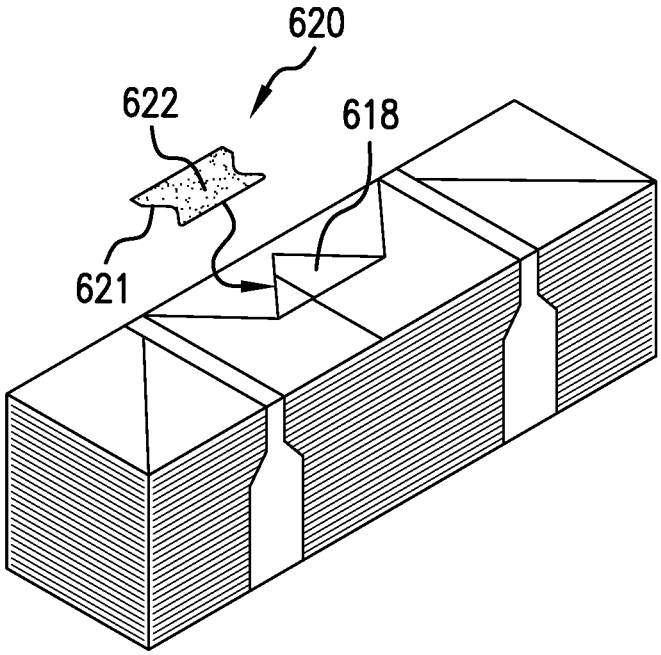
FIG. 6B is a perspective view of the stock material unit of FIG. 6A with a connector transitioning from a first position to a second position.
Figure 6C:
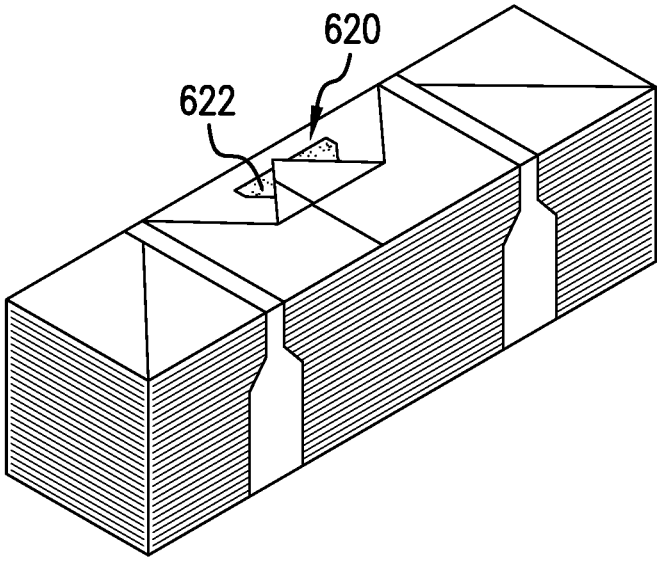
FIG. 6C is a perspective view of the stock material unit of FIG. 6A with the connector positioned in a second position.

Another embodiment of a stock material unit 600 is shown in FIGS. 6A-6C, which may include features similar or different than previously described stock material units. This embodiment 600 has a splice member 630 with a connector 620 that includes an adhesive bonding member. In other examples, a cohesive bonding member may be used.

Similar to the embodiment of FIGS. 5A-5F, in a first position, which can be a shipping and handling position, the splice member 630 may be positioned on a stack retainer, such as a strap assembly 610 that is positioned at least partially about a strip of sheet material 601. The strap assembly 610 may include a release layer so that the connector 620 may be easily removed from the strap 610 when moving the connector from the first position, shown in FIG. 6A to the second position, shown in FIG. 6C. The release layer may be provided in other locations. The connector 620 may include only a single connector adhesive layer 622, which may be exposed when the connector 620 is separated from the strap assembly 610. In the second position, the connector 620 may be positioned on the underside of section 618, so that a portion of the connector adhesive layer 622 positioned adjacent the connector substrate 621 is exposed.

In some examples, the connector 620 may be shaped in a suitable shape, such as circular, rectangular, butterfly, oblong, or other shape.

Figure 7A:
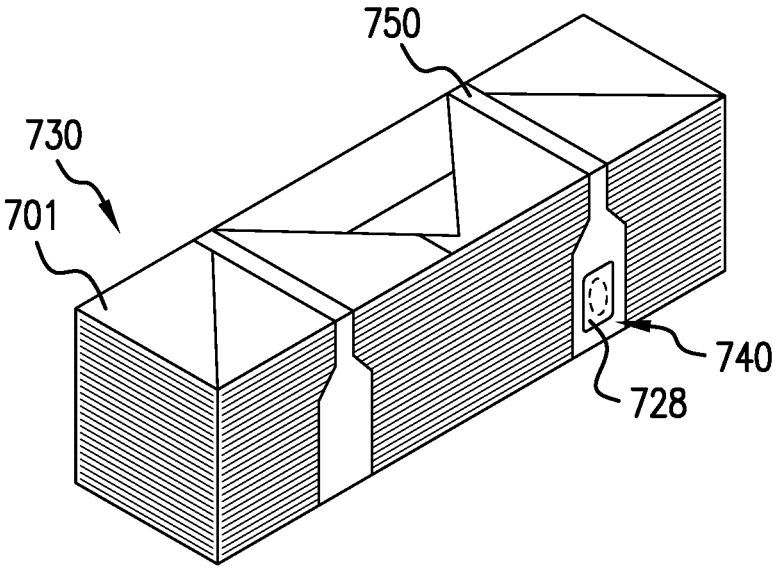
FIG. 7A is a perspective view of an embodiment of a stock material unit.
Figure 7B:
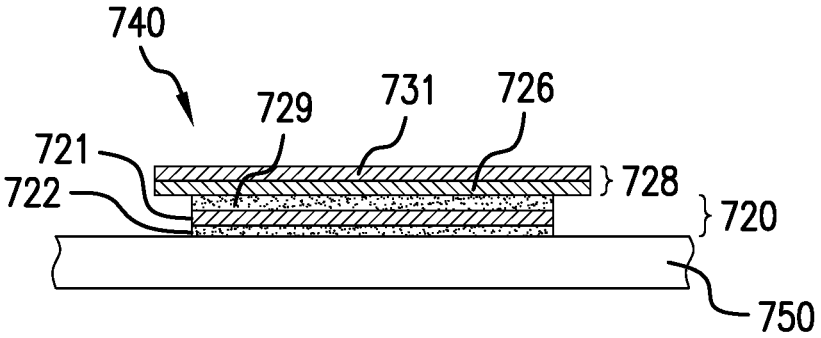
FIG. 7B is a cross-sectional view of a portion of the stock material unit of FIG. 7A.
Figure 7C:
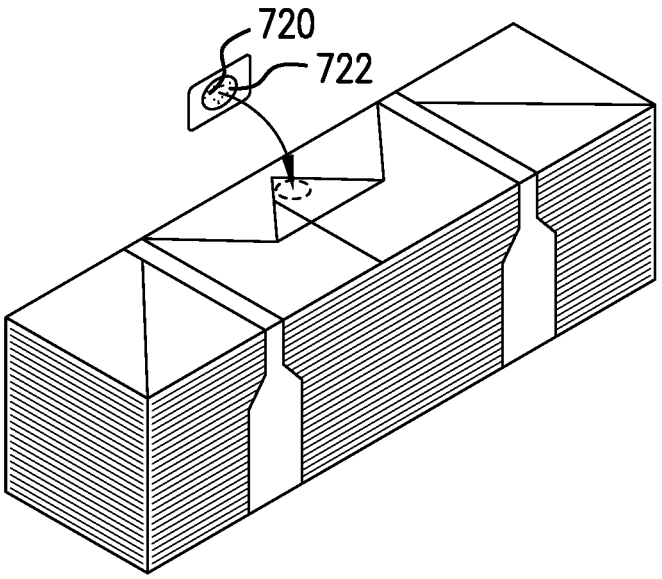
FIG. 7C is a perspective view of the embodiment of the stock material unit of FIG. 7A with the connector being transitioned to a second position.
Figure 7D:
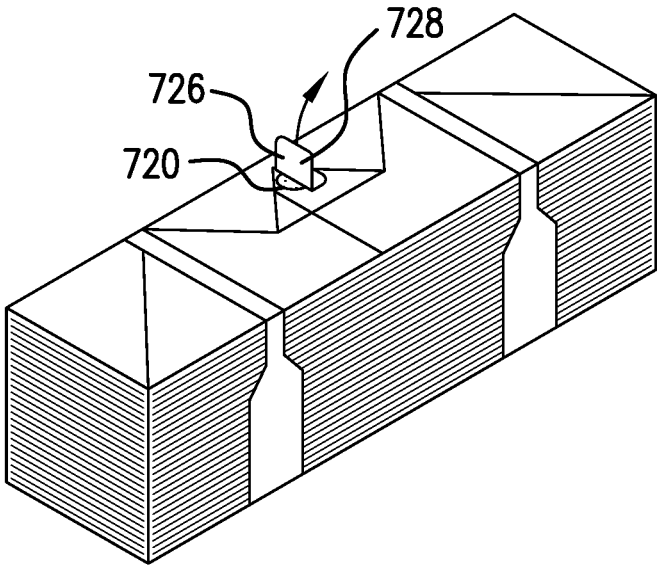
FIG. 7D is a perspective view of the embodiment of the stock material unit of FIG. 7A with the cover being removed.
Figure 7E:
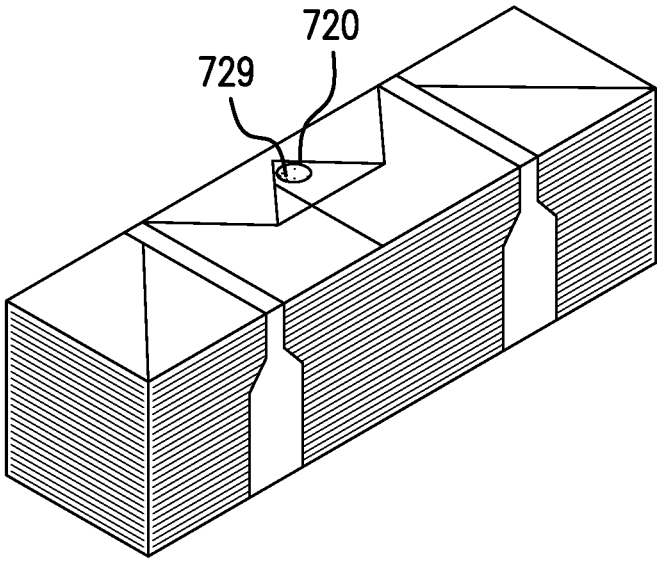
FIG. 7E is a perspective view of the embodiment of the stock material unit of FIG. 7A with the cover removed.

Another embodiment of a stock material unit is shown in FIGS. 7A-7E which may include features similar or different than previously described stock material units. FIG. 7A is a perspective view of a stock material unit. FIG. 7B is a cross-sectional view of a portion of the stock material unit of FIG. 7A. FIG. 7C is a perspective view of the embodiment of the stock material unit of FIG. 7A with the connector being transitioned to a second position. FIG. 7D is a perspective view of the embodiment of the stock material unit of FIG. 7A with the cover being removed. FIG. 7E is a perspective view of the embodiment of the stock material unit of FIG. 7A with the cover removed.

The stock material unit 730 of FIGS. 7A-7E may include features similar or different than previously described stock material units. This embodiment 730 has a splice member 740 with a connector 720 that includes an adhesive bonding member. In other examples, a cohesive bonding member may be used.

Similar to stock material units 500 and 600, in a first position, the splice member 740 may be positioned adjacent a surface of the strap assembly 750. In some examples, the splice member 740 may include a base and a connector 720 having a cover 728. In other examples, the splice member may not include a base and the strap assembly 750 may include a release layer to help a user separate the connector 720 from the strap assembly 750. In the example of FIGS. 7A-7E, the overall shape of the connector 720 and the cover 728 may be similar, but the cover 728 may have a larger size. This may enable a user to more easily peel away the connector 720 from the strap assembly 750 without contaminating the connector adhesive layer 722. In other examples, the edges of the cover 728 that protrude past the connector 720 are held down or secured onto a release surface on the strap, such as by an adhesive, and are then peeled up similar to the embodiment where the cover 728 is larger than the connector 720.

As shown in FIG. 7B, the connector 720 includes a connector substrate 721 and two connector adhesive layers 722 and 729, positioned on opposite sides of the connector substrate 721. The cover 728 may include protective layer 731, and a cover release layer 726. The cover release layer 726 is positioned adjacent the connector adhesive layer 729 when the splice member 740 is positioned in a first position.

As shown in FIG. 7A, when the splice member 740 is positioned in a first position, the connector adhesive layer 722 is positioned adjacent a surface of the strap assembly 750. In some examples, the corresponding surface of the strap assembly is coated with a release layer to aid in the removal or separation of the splice member 740 from the strap assembly 750. In some examples, when the user or operator is ready to daisy chain the strip of sheet material 701 of stock material unit 730 with a strip of sheet material of another stock material unit, the user or operator may peel the splice member 740 away from the strap assembly 750 and expose the connector adhesive layer 722, as shown in FIG. 7C. The connector adhesive layer 722 may then be positioned adjacent a first end of the strip of sheet material 701, as shown in FIG. 7D. The cover 728 may then be removed to expose the second connector adhesive layer 729, as shown in FIG. 7E, in preparation to couple or attach the first end of the sheet of strip material 701 to a second end of an alternate strip of sheet material.

Figure 8A:
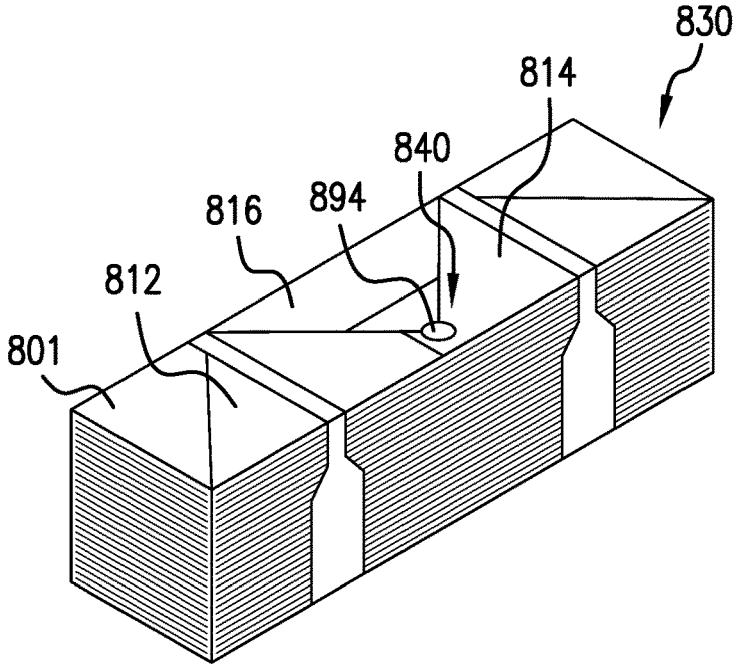
FIG. 8A is a perspective view of an embodiment of a stock material unit.
Figure 8B:
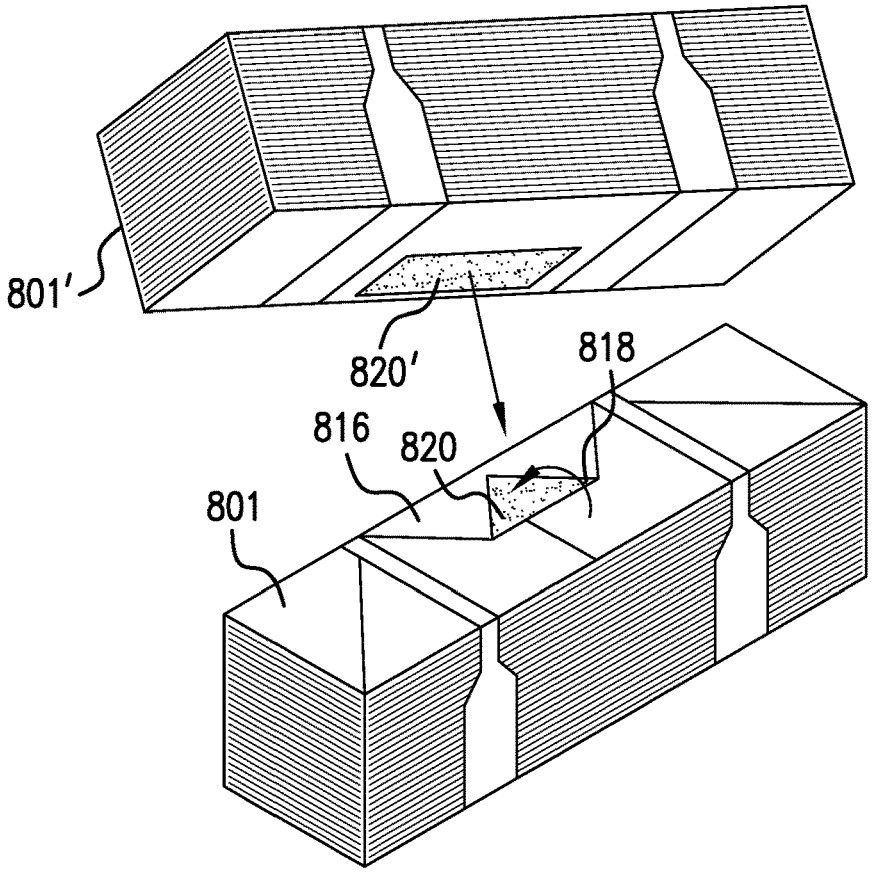
FIG. 8B is a perspective view of the embodiment of the stock material unit of FIG. 8A in the process of being assembled with another stock material unit.

Another embodiment of a portion of a stock material unit is shown in FIGS. 8A-8B, which may include features similar or different than previously described stock material units. This embodiment 830 has a splice member 840 with a connector 820 that includes a cohesive bonding member. In other examples, an adhesive bonding member may be used.

FIG. 8A is a perspective view of an embodiment of a stock material unit. The strip of sheet material 801 of the stock material unit 830 includes a splice member 840 that includes a connector 820 and a sealing sticker 894. The connector 820 is formed by a layer of cohesive. In the first position, as shown in FIG. 8A, the connector 820 is positioned on the underside of section 816 of the strip of sheet material 801, and the top of section 816 is temporarily positioned adjacent to sections 814, 812 or combinations thereof using the seal 894 such as a sticker 894. In some examples, the sealing sticker 894 includes a bonding member, typically an adhesive, to help temporarily secure the section 816 to sections 814, 812 for shipping and handling, to keep the cohesive of the connector 820 covered, and prevent exposure thereof. The bonding material on the sticker 894 can have light adhesion to the lower layer of the stack so that it is releasably secured, such as peelable, or it can have strong adhesion so that the sticker of part of the strip of material needs to be broken to fold the portion of section 816 back to expose the cohesive of the connector 820.

FIG. 8B is a perspective view of the embodiment of the stock material unit of FIG. 8A in the process of being assembled with another stock material unit. As shown in FIG. 8B, the section 816 has been folded back over to expose section 818 and the connector 820. This would enable a user to secure the strip of sheet material 801 to an alternate strip of sheet material, 801', via the connecter 820 and another connector 820' positioned on the bottom of the alternate strip of sheet material, 801'. Similar to the connector 820, the connector 820' uses a cohesive bonding member that may be used to bond connector 820 and 820' to help form spliced strips of sheet material to supply to a dunnage converter machine.

Figure 9A:
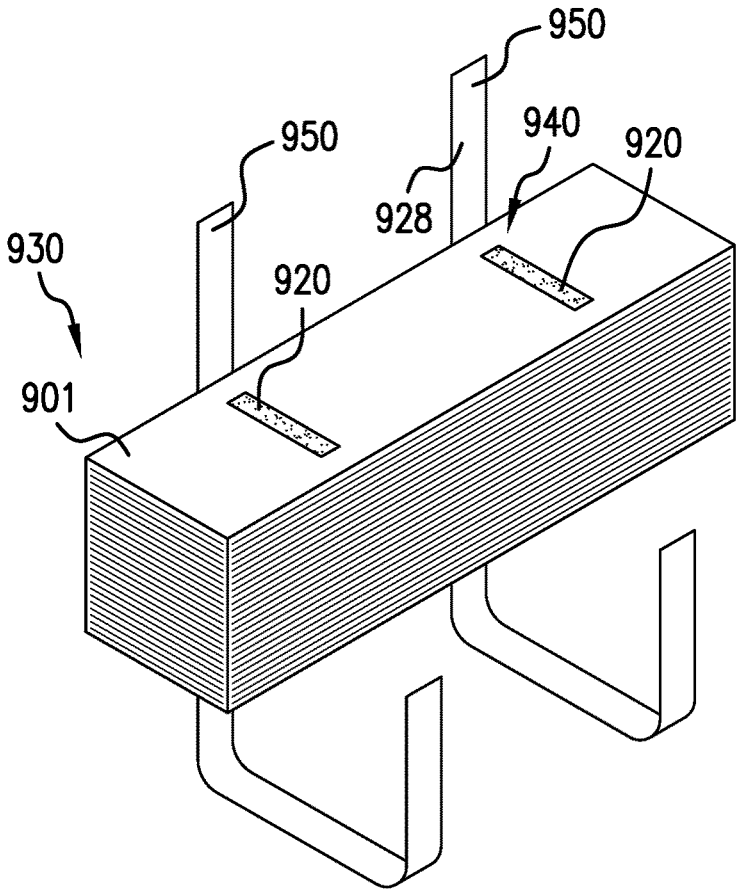
FIG. 9A is a perspective exploded view of an embodiment of a stock material unit.
Figure 9B:
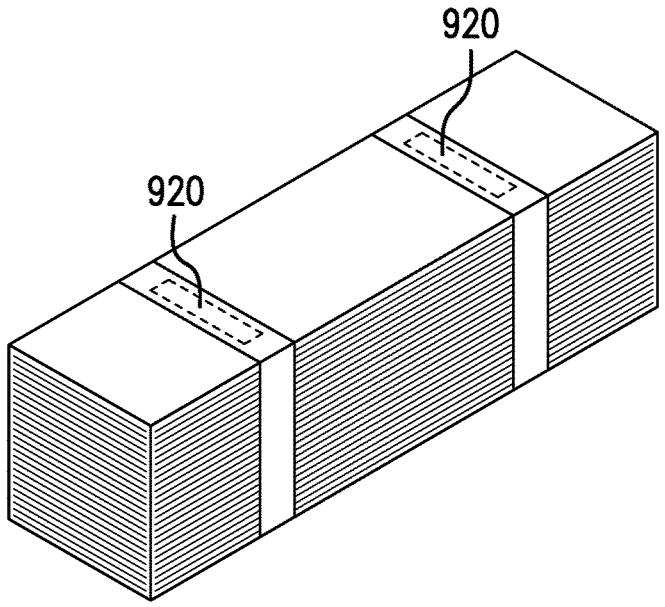
FIG. 9B is a perspective view of the embodiment of the stock material unit of FIG. 9A.
Figure 9C:
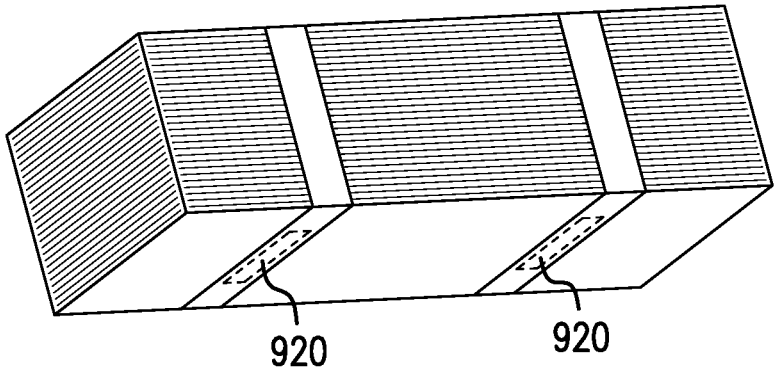
FIG. 9C is an alternate perspective view of the embodiment of the stock material unit of FIG. 9A.

Another embodiment of a portion of a stock material unit is shown in FIGS. 9A-9C which may include features similar or different than previously described stock material units. The embodiment 930 has a splice member 940 with a connector 920 that includes a cohesive bonding member. In other examples, an adhesive bonding member may be used.

FIG. 9A is a perspective exploded view of an embodiment of a stock material unit. FIG. 9B is a perspective view of the embodiment of the stock material unit of FIG. 9A. FIG. 9C is an alternate perspective view of the embodiment of the stock material unit of FIG. 9A.

In some examples a first end of the strip of sheet material 901 may be tapered, similar to that of 500. In other examples, the first end of the strip of sheet material 901 may be generally rectangular shaped and not tapered.

In some examples, the stack retainer 950 may be similar to the strap assembly 550 of FIG. 5A.

As shown in FIGS. 9A and 9B, in some examples, the splice member 940 may include a connector 920 positioned on or near a first end of a beginning or the top of the strip of sheet material 901 and a second connector 920 positioned on or near a second end of the beginning of the strip of sheet material 901. As shown in FIG. 9C, the connector 920 may also include a connectors 920 positioned on or near the end of the strip of sheet material 901, such as the bottom of the strip of the sheet material 901. Each connector 920 includes a cohesive applied directly to the strip of sheet material 901 to form a cohesive bonding member. In the first position, a cover 928 can be provided over the cohesive 920, which can easily be released therefrom by a user, as the cohesive 920 is weakly bonded to the cover. In the embodiment shown, the cover 928 is provided by the strap 550 that holds the strip of sheet material 901 in a transporting and handling position, so that the strap is positioned over the cohesive 920, thereby covering and protecting the cohesive 920 until the stock material unit 930 is ready to be spliced.

In use, the stack retainer 950 is removed by a user, and another strip of sheet material, such as with the same configuration, may be positioned so that the cohesive bonding members of the two units align, forming a strong bond to each other, and the ends of the units are spliced together.

Figure 10A:
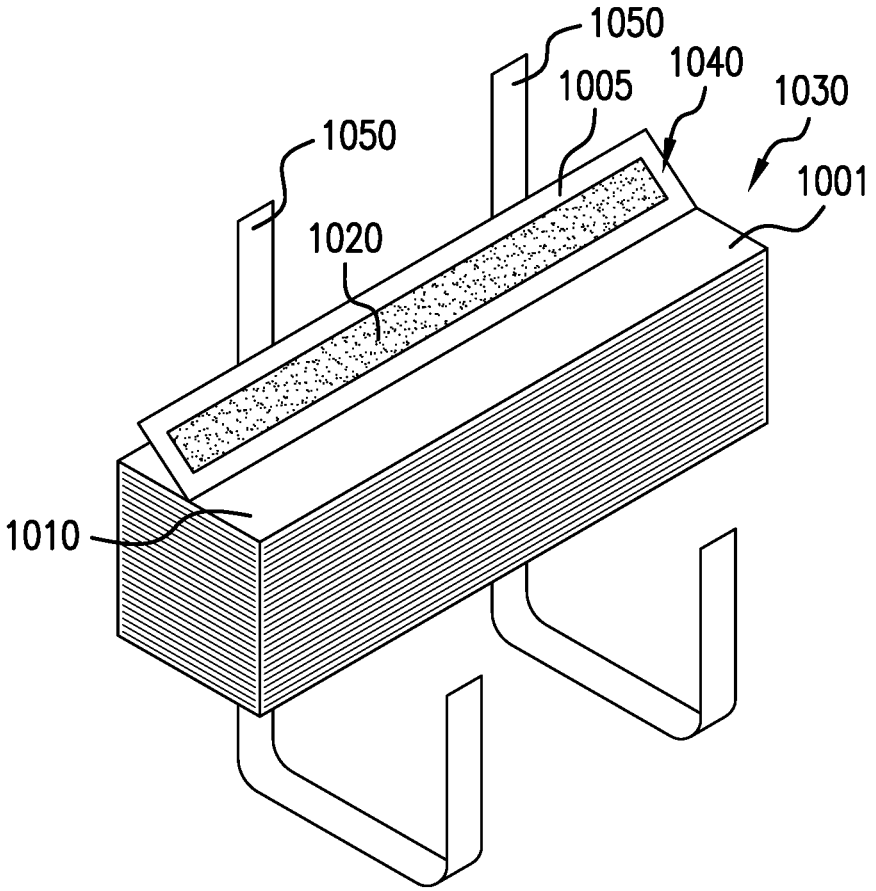
FIG. 10A is a perspective exploded view of an embodiment of a stock material unit.
Figure 10B:
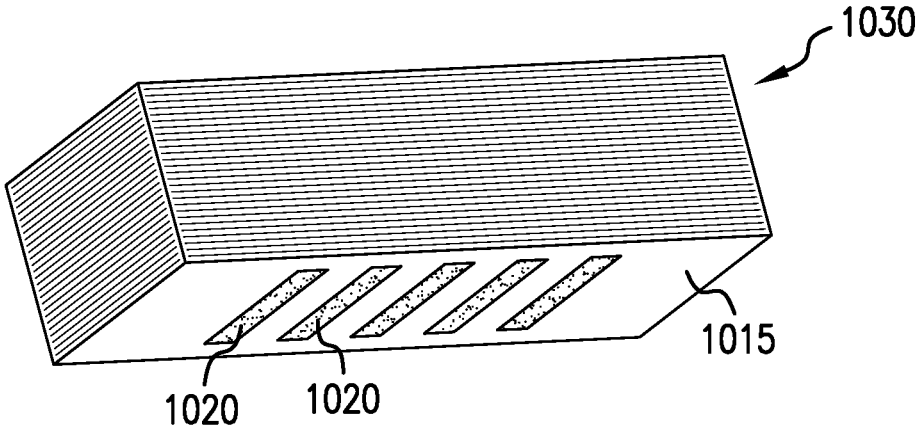
FIG. 10B is an alternate perspective view of the embodiment of the stock material unit of FIG. 10A with the stack retainer removed.

Another embodiment of a stock material unit is shown in FIGS. 10A-10B, which may include features similar or different than previously described stock material units. This embodiment 1030 has a splice member 1040 with a connector 1020 that includes a cohesive bonding member. In other examples, an adhesive bonding member may be used. FIG. 10A is a perspective exploded view of an embodiment of a stock material unit 1030. FIG. 10B is an alternate perspective view of the embodiment of the stock material unit of FIG. 10A with the stack retainer removed. The embodiment shown in FIGS. 10A-10B can include one or more stack retainers such as strap assemblies 1050 which can be similar to stack retainers 400, 550, and/or 950, previously described, and which can generally surround the strip of sheet material, to form an enclosed package.

The splice member 1040 is used to daisy chain the first end of the strip of sheet material 1001 to an alternate strip of sheet material. The first end of the strip of sheet material 1001 may include a folded section 1005 positioned adjacent a section 1010. When the connector 1020 is positioned in a first position, such as a shipping and handling position, the folded section 1005 may be positioned adjacent the section 1010, and a cohesive surface formed as connector 1020 may be positioned between the sections 1005, 1010. In this example, the connector 1020 is a layer of cohesive applied to the section 1005. When the connector 1020 is positioned in the second position, the section 1005 is flipped or rotated away from the section 1010, and the connector 1020 is exposed. In the second position, the connector 1020 is ready to be used to daisy chain the first end of the strip of sheet material 1001 with a second end of an alternate strip of sheet material.

The splice member 1040 is used to daisy chain the second end of the strip of sheet material 1001 to an additional alternate strip of sheet material. The splice member 1040 includes another connector 1020 positioned on section 1015 on the bottom of the strip of sheet material 1001. In this example, the connector 1020 is a layer of cohesive applied to the section 1015. As shown in FIG. 10B, in some examples, the connector 1020 extends along a transverse dimension of the strip of sheet material 1001. In some examples, a cover may also be positioned adjacent the connector 1020 applied to section 1015 to help prevent damage or contamination to the connector 1020 prior to daisy-chaining.

As shown in FIG. 10B, in some examples, the connector 1020 applied to section 1015 may include multiple instances of the connector 1020. In some examples, connectors 1020 are arranged along the transverse dimension of the strip of sheet material 1001, but positioned in a longitudinal direction. The connectors 1020 may include multiple instances in a variety of shapes that extend in a variety of directions positioned adjacent the second end of the strip of sheet material 1001.

An embodiment of a stock material unit 1100 is shown in FIGS. 11A-D, which may include features similar or different than previously described stock material units. For example, various features of the stock material unit, such as the stock material unit 300, stock material unit 500; stock material unit 600; stock material unit 730; stock material unit 830 or stock material unit 930 are usable in combination with the splice member to help secure or daisy chain a strip of sheet material of a first stock material unit to the strip of sheet material of another stock material unit to help form a continuous stream of material for use in a dunnage conversion machine. The embodiment of FIGS. 11A-11D includes the stock material unit 1100 and splice member, such as splice member 1140.

With reference to the strip of sheet material 1101 of stock material unit 1100, the triangular section 1116 is secured to the sections 1112 and 1114 (e.g., to facilitate storage and/or transportation of the stock material unit 1100). In some examples, a strap assembly 1150 secures the triangular section 1116. In other examples, a connecting member secures the triangular section 1116.

In some examples, the splice member 1140 includes a base, such as base 1110 and a connector, such as connector 1120. In use, the connector may be used to connect or splice the strip of sheet material of stock material unit to other strips of sheet material of other stock material units to form a continuous stream of material that may be fed into the dunnage converter machine. The connector includes a bonding member that is suitable to splice strips of sheet material together. In the example of FIGS. 11A-11D, the bonding member 1122 of the connector 1120 is an adhesive. However, in other examples, other species of bonding members, such as a cohesive, may be used. In use, the base 1110 may be used to position and protect the connector 1120 during transportation of the stock material unit 1100. In some examples, the splice member does not include the base.

Figure 11A:
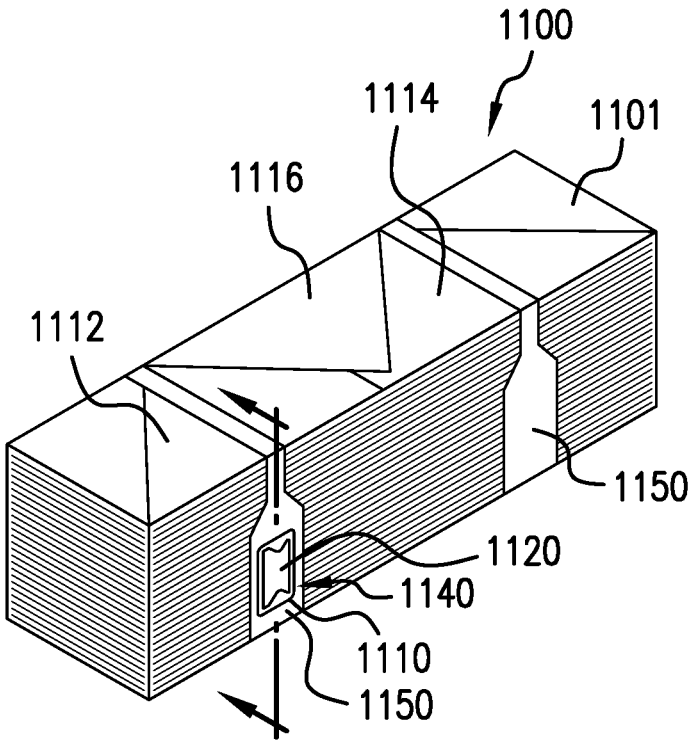
FIG. 11A is a perspective view of an embodiment of a stock material unit with a connector in a first position.

In the example of FIG. 11A, the base 1110 may include a base substrate having a base adhesive layer 1112 and a base release layer 1113. The connector 1120 may include a connector substrate having a connector adhesive layer 1122 and a cover 1128.

In a first position, such as FIG. 11A when the stock material unit 1100 is being handled and prior to being loaded into the dunnage conversion machine and coupled with an alternate second stock material unit, the splice member 1140 is secured to the stack retainer, such as a strap assembly 1150.

Portions of a splice member 1140 secures stock material unit 1100 (e.g. 1130*a*) to another adjacent stock material unit 1100 (e.g. 1130*b*) stacked below, as shown for example in FIG. 11D. In one example, the triangular section 1116 of one stock material unit 1100 (e.g. 1130*b*) has a splicing connector 1120 attached thereto, which in turn is also attachable to the bottom of an adjacent stock material unit 1100 (e.g. 1130*a*) stacked above. Once spliced the stock material unites 1130*a* and 1130*b* form the supply 2300*c* as shown in FIG. 11D.

Similar to other embodiments, in this embodiment, the connector 1120 is movable between a first location and a second location. In this first position, the surface of the strap assembly 1150 is adjacent the base adhesive layer 1112 of the base 1110 of the splice member 1140. In some examples, the splice member 1140 does not include a base 1110 and the surface of the strap assembly 1150 may include a release coating or layer to help the connector 1120 be more readily separated from the strap assembly 1150 when a user is ready to remove the splice member 1140 from the strap assembly 1150 and reposition the splice member 1140 in a second position, such as that shown in FIG. 11D.

When a user or operator is ready to connect a first end of the strip of sheet material 1101 of the stock material unit 1100 to a second end of an alternate of strip of sheet material of an alternate stock material unit, the user may place the stock material unit 1100 in the stack carrier or other holding mechanism to feed into the converting machine. The user may detach the connector 1120 from the base 1110 by separating the connector adhesive layer 1122 from the base release layer 1113. In some examples, the connector 1120 includes an overhang to help facilitate separating or lifting the connector 1120 from the base 1110. The overhang may include a non-adhesive section to help protect a user or operator from accidentally adhering the connector 1120 to their fingers or from contaminating the connector adhesive layer 1122 when it is separated from the base 1110.

Figure 11B:
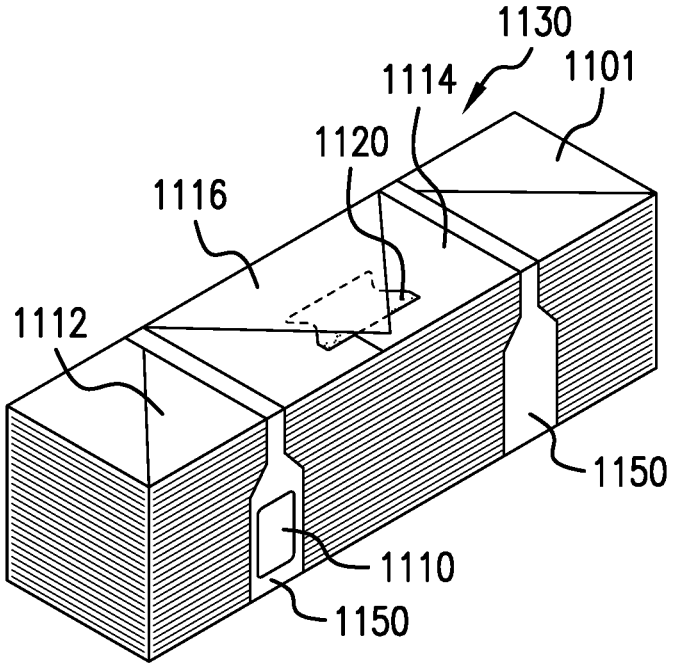
FIG. 11B is a perspective view of the stock material unit of FIG. 11A with the connector in a second position.
Figure 11C:
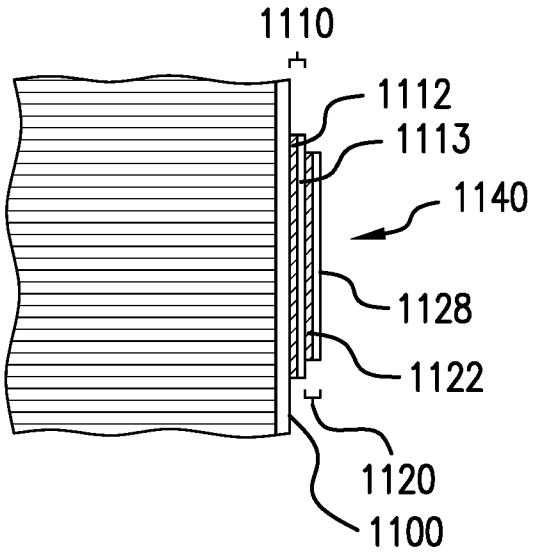
FIG. 11C a cross-sectional view of a portion of the stock material unit of FIG. 11A.
Figure 11D:
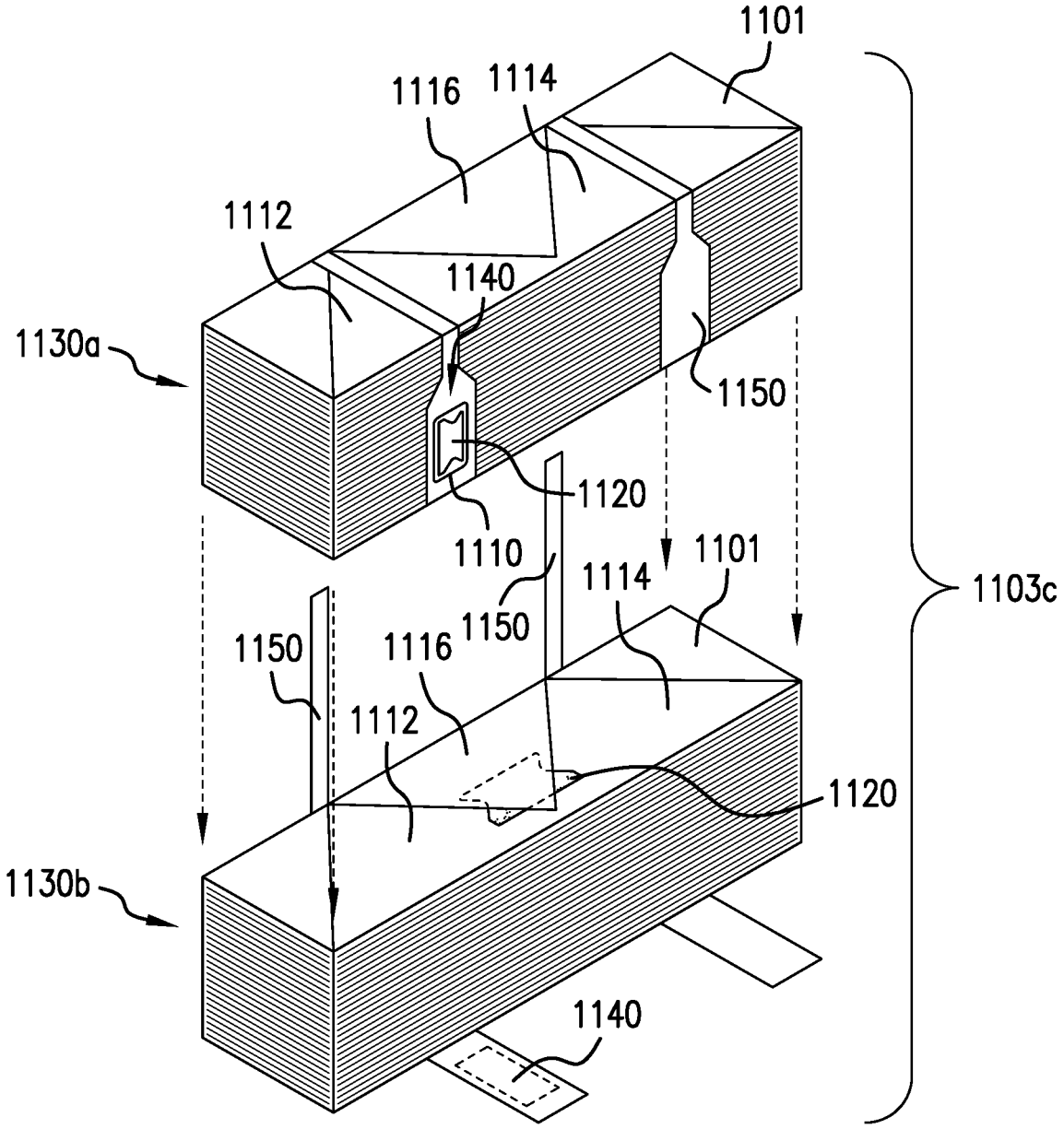
FIG. 11D is a perspective view of the stacking of stock material units of FIG. 11A with the connector in the second position to connect the two units.

In general, the embodiments illustrated in FIGS. 11A-11D are similar to those illustrated in FIGS. 6A-6C, with the exception that the section 1116 is not folded back as the section 618 is in FIGS. 6A-6C. Instead the section 1116 remains extended and the connector 1120 is attached on the underside of section 1116 as shown in FIG. 11B with the sides of the connector 1120 and the bonding member 1122 thereof exposed upwards in order to contact the next unit of stock material (e.g. 1130*a* as shown in FIG. 111D) stacked thereon. In some examples, the strip of sheet material 1101 includes an optional printed target 1195 to help the user align the connector 1120 in a correct position. Once positioned, the exposed connector adhesive layer 1122 may then be used to connect a second end of an alternate strip of sheet material of an alternate stock material unit to the first end of the strip of sheet material 1101 of the stock material unit 1100.

In other examples, a connector similar to 1120, in which the bonding member is a cohesive, unlike the connector adhesive layer 1122 used in FIGS. 11A-11D.

While the splice assemblies described herein may be used with stock material units that have a folded continuous sheet (e.g., fanfold material), it should be appreciated that the splice assemblies may be use with and/or included in stock material units that include one or more sheets of any number of suitable configurations or combinations. For example, as described above, stock material units may include a continuous sheet that is configured into a roll, may include multiple sheets that are stacked together and/or positioned near one another, etc.

What is claimed is:

1. A stock material unit for a dunnage conversion machine, the stock material unit comprising:

a supply unit including a first strip of sheet material arranged in a high-density configuration and including a first end and a second end opposite the first end, wherein in the high-density configuration the first strip is folded into a fanfold configuration having a plurality of opposing folds that define opposing sheet sections, wherein the fanfolded first strip has a prismoid shape; and a splicing member releasably stuck to the supply unit, the splicing member including a connector that includes a bonding member releasably stuck to the supply unit in a first position;

wherein the splicing member is releasable from the first position on a first face of the prismoid of the supply unit and repositionable to a second position on a different face of the prismoid of the supply unit by the bonding member, wherein in the second position the bonding member is affixed to the first end for sticking to a second end of a second strip of sheet of the material with sufficient strength to splice together the first and second strips of sheet material.

2. The stock material unit of claim 1, wherein the supply unit comprises a stack retainer that extends around at least a portion of the strip of sheet material thereby holding the strip of sheet material in the high-density configuration.

3. The stock material unit of claim 2, wherein the first position is on the stack retainer, which stack retainer includes a release portion at the first position configured such that the bonding member stuck thereon is releasable therefrom and reusable.

4. The stock material unit of claim 1, wherein:

the connector includes a substrate; and the bonding member has first and second portions disposed on opposite sides of the substrate, such that the first portion of the bonding member is releasably and reusably stuck on the supply unit, and a cover is releasably stuck to the second portion of the bonding member, both portions configured for attaching to and splicing together the first and second strips of sheet material.

5. A method for daisy chaining separate stock material units for a dunnage conversion machine, the method comprising:

providing a stock material unit for a dunnage conversion machine, the stock material unit comprising:

a supply unit including a first strip of sheet material arranged in a high-density configuration and including a first end and a second end opposite the first end; and a splicing member releasably stuck to the supply unit, the splicing member including a connector that includes a bonding member releasably stuck to the supply unit in a first position;

removing the splicing member from the first position on the supply unit; and applying the splicing member to a second position on the supply unit in which the connector is stuck to the first end by the bonding member, wherein in the second position, the bonding member is positioned for sticking to a second end of a second continuous sheet of the material to daisy chain the first and second strips of sheet material.

6. The method of claim 5, wherein the supply unit comprises a stack retainer that extends around at least a portion of the strip of sheet material thereby holding the strip of sheet material in the high-density configuration.

7. A stock material unit for a dunnage conversion machine, the stock material unit comprising:

a first strip of sheet material at least partially defining a three-dimensional configuration and including a first end and a second end opposite the first end; and a splicing member that includes:

a first cohesive layer affixed to a first end of the sheet material, and a second cohesive layer affixed to a second end of the sheet material;

wherein the cohesive layers are of a cohesive material that bonds strongly to corresponding cohesive layers, and has a weak bond to the strip of sheet material; and wherein the first and second cohesive layers are positioned for cohesively adhering to a cohesive at an end of a second strip of sheet material of a second stock material unit of the same construction as the stock material unit to daisy chain the first and second strips of sheet material together.

8. A stock material unit for a dunnage conversion machine, the stock material unit comprising:

a supply unit including a first strip of sheet material arranged in a high-density configuration and including a first end and a second end opposite the first end; and a splicing member releasably stuck to the supply unit, the splicing member including:

a connector that includes:

a bonding member releasably stuck to the supply unit in a first position, a first connector portion, and a hinge, and a cover that has a release portion that is releasably stuck to the bonding member to protect the bonding member, wherein:

at least a first portion of the bonding member is disposed and protected between the cover and the first connector portion in the first position, and the hinge pivotally connects the cover to the first connector portion such that the cover is pivotable to expose the first portion of the bonding member in a second position to enable the bonding member to stick to at least one of the first or second strips of sheet material;

wherein the splicing member is releasable from the first position and repositionable and affixable to a second position on the supply unit by the bonding member; and wherein in the second position with the cover pivoted to expose the first portion of the bonding member, the bonding member is positioned for sticking to a second end of a second strip of sheet of the material to splice the first and second strips of sheet material.

9. The stock material unit of claim 8, wherein:

the connector includes a substrate on which the bonding member is disposed; and the substrate extends to define the cover and includes a first substrate portion and a first hinge that pivotally connects the cover to the first substrate portion, wherein at least a portion of the bonding member is disposed and protected between the cover and the first portion in the first position, and the cover is pivotable to expose said portion of the bonding member in the second position.

10. The stock material unit of claim 9, wherein a second portion of bonding member is disposed on an opposite side of the first substrate portion from the first portion of the bonding member.

11. The stock material unit of claim 9, wherein:

the cover includes first and second cover flaps; and the hinge includes first and second hinges at different locations of the first substrate portion and respectively pivotally connecting the first and second cover flaps to the first substrate portion;

wherein the first and second hinges and the first and second cover flaps are disposed and configured such that in the first position, the first and second cover flaps are pivotable to cover the first portion of the bonding member.

12. The stock material unit of claim 11, wherein the first and second hinges are disposed on opposite sides of the first substrate portion so that when squeezed towards each other, the first and second cover flaps tend to begin peeling off the first portion of the bonding member.

13. The stock material unit of claim 12, wherein a split line is defined between the first and second cover flaps.

14. A stock material unit for a dunnage conversion machine, the stock material unit comprising:

a supply unit including a first strip of sheet material arranged in a high-density configuration and including a first end and a second end opposite the first end, the first end having a narrowed portion that is narrower than a main portion of the strip of material; and a splicing member releasably stuck to the supply unit and including a connector that has a bonding member releasably stuck to the supply unit in a first position, wherein:

the splicing member is releasable from the first position on the supply unit and repositionable to a second position on the supply unit by the bonding member, and the connector is wider than the narrowed portion, such that the connector is dimensioned to protrude on opposite sides past the narrowed portion in the second position, in which second position the bonding member is affixed to the first end for sticking a portion of the connector that protrudes on opposite sides of the narrowed portion to a second end of a second strip of sheet of the material with sufficient strength to splice together the first and second strips of sheet material.

15. A stock material unit for a dunnage conversion machine, the stock material unit comprising:

a supply unit including:

a first strip of sheet material arranged in a high-density configuration and including a first end and a second end opposite the first end, and a stack retainer that extends around at least a portion of the strip of sheet material thereby holding the strip of sheet material in the high-density configuration, which stack retainer includes a release portion; and a splicing member including a connector that includes a bonding member releasably and reusably stuck to the release portion of the stack retainer in a first position of the splicing member, such that splicing member is releasable from the stack retainer and repositionable and affixable to a second position on the supply unit by the bonding member, wherein in the second position the bonding member is positioned for sticking to a second end of a second strip of sheet of the material to splice the first and second strips of sheet material.

16. The stock material unit of claim 15, wherein the stack retainer comprises a strap that is significantly narrower than the strip material in the high-density configuration.

17. The stock material unit of claim 16, wherein the strap is sufficiently strong to carry the first strip of sheet material in the high-density configuration thereby and capable of being torn by hand such that the strap can be torn and removed from the strip of sheet material after loading the strip of sheet material in a conversion machine.

18. The stock material unit of claim 16, wherein the strap comprises a plurality of straps that are collectively strong enough to carry the strip of sheet material in the high-density configuration thereby.

19. The stock material unit of claim 15, wherein the connector includes a substrate on which the bonding member is disposed.

20. The stock material unit of claim 15, wherein the splicing member includes a cover that has a release portion that is releasably stuck to the bonding member to protect the bonding member, which cover is releasable from the bonding member to enable the bonding member to stick to at least one of the first or second strips of sheet material.

21. The stock material unit of claim 20, wherein the connector includes:

a first connector portion; and a hinge that pivotally connects the cover to the first connector portion;

wherein at least a first connector portion of the bonding member is disposed and protected between the cover and the first connector portion in the first position, and the cover is pivotable to expose the first portion of the bonding member in the second position.

22. The stock material unit of claim 15, wherein the splicing member further comprises a base including a substrate with a release portion, the base stuck to the first supply unit, wherein the connector is releasably stuck to the base release portion in the first position.

23. The stock material unit of claim 22, wherein:

the base is non-releasably stuck to the stack retainer; and the connector is releasably stuck to the base release portion in the first position.

24. The stock material unit of claim 15, wherein the first end has a narrowed portion that is narrower than a main portion of the strip of material, and the connector is wider than the narrowed portion such that the connector is dimensioned to protrude on opposite sides past the narrowed portion.

25. The stock material unit of claim 15, wherein the bonding member is an adhesive.

26. The stock material unit of claim 15, wherein the bonding member is a cohesive.

27. The stock material unit of claim 15, wherein in the high-density configuration the first strip is folded into a fanfold configuration having a plurality of opposing folds that define opposing sheet sections.

28. The stock material unit of claim 27, wherein:

the fanfolded first strip has a prismoid shape;

the first position is on a first face of the prismoid; and the second position is on a different face of the prismoid.

29. The stock material unit of claim 15, wherein a same portion of the bonding member is releasably stuck to the supply unit in the first position and affixed to the first end in the second position.

30. The stock material unit of claim 15, wherein the first position is on the supply unit, which supply unit includes a release portion at the first position configured such that the bonding member stuck thereon is releasable therefrom and reusable.

31. The stock material unit of claim 30, wherein the release portion is on the first strip of material.

* * * * *